US007234990B2

(12) United States Patent
Leonov et al.

(10) Patent No.: US 7,234,990 B2
(45) Date of Patent: Jun. 26, 2007

(54) REMOTE-CONTROLLED TOY VEHICLE HAVING MULTI-MODE DRIVE MECHANISM

(75) Inventors: Vladimir Leonov, San Pedro, CA (US); Nathan Bloch, Cherry Hill, NJ (US); Donald L. Balkie, Tuckerton, NJ (US)

(73) Assignee: Mattle, Inc., El Segundo, CA (US)

( * ) Notice: Subject to any disclaimer, the term of this patent is extended or adjusted under 35 U.S.C. 154(b) by 115 days.

(21) Appl. No.: 11/056,341

(22) Filed: Feb. 11, 2005

(65) Prior Publication Data

US 2005/0250414 A1 Nov. 10, 2005

Related U.S. Application Data

(60) Provisional application No. 60/576,273, filed on Jun. 2, 2004, provisional application No. 60/543,760, filed on Feb. 11, 2004.

(51) Int. Cl.
*A63H 17/21* (2006.01)
*A63H 17/00* (2006.01)
*A63H 17/42* (2006.01)

(52) U.S. Cl. ..... 446/440; 446/456; 446/462; 446/465

(58) Field of Classification Search ..... 446/440, 446/456, 461, 462, 463, 465, 470
See application file for complete search history.

(56) References Cited

U.S. PATENT DOCUMENTS 2,698,497 A 1/1955 Muller
4,231,183 A 11/1980 Lahr
4,329,886 A 5/1982 Branstner
4,553,947 A 11/1985 Weiland et al.
4,565,538 A 1/1986 Kennedy et al.
4,576,583 A 3/1986 Yoneda
4,892,503 A 1/1990 Kumazawa
4,902,271 A 2/1990 Yoneda
5,100,368 A 3/1992 Chien
5,135,428 A * 8/1992 Shibayama et al. ..... 446/463
5,304,088 A * 4/1994 Suimon ..... 446/443
5,709,583 A 1/1998 Suto et al.
5,762,532 A 6/1998 Ishizuka et al.
5,785,572 A 7/1998 Levy et al.
5,961,368 A * 10/1999 Chu ..... 446/457
6,095,891 A 8/2000 Hoeting et al.
6,682,394 B2 1/2004 Tilbor et al.

FOREIGN PATENT DOCUMENTS

WO WO 01/36063 A3 5/2001

* cited by examiner

*Primary Examiner*—John A. Ricci
(74) *Attorney, Agent, or Firm*—Akin Gump Strauss Hauer & Feld LLP

(57) ABSTRACT

A remote-controlled toy vehicle includes a plurality of road wheels supporting the toy vehicle for movement. A driving motor is selectively reversible between first and second directions of rotation and is drivingly connected to at least one of the road wheels through a drive mechanism. The drive mechanism operates in at least two modes, such that operation of the driving motor in either of its opposing directions of rotation causes rotation of the at least one road wheel to propel the toy vehicle in only a forward vehicle direction. A second motor can provide braking action or a third mode of forward vehicle propulsion.

37 Claims, 14 Drawing Sheets

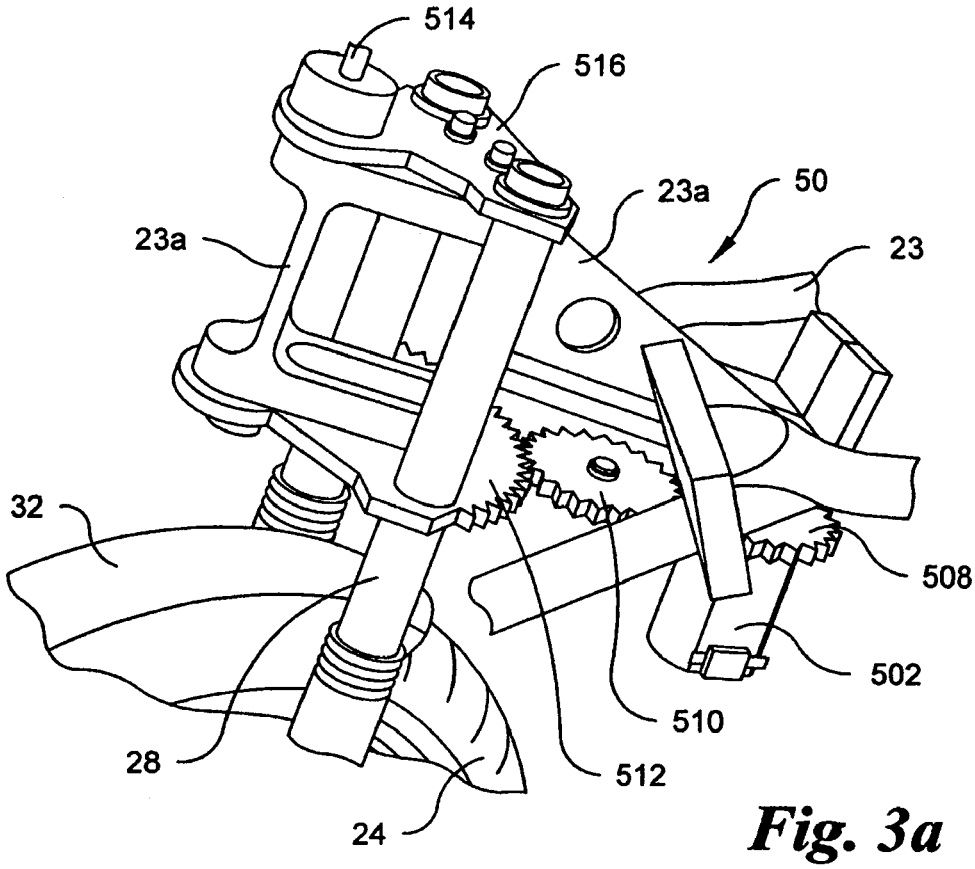
Fig. 3a
Fig. 3b
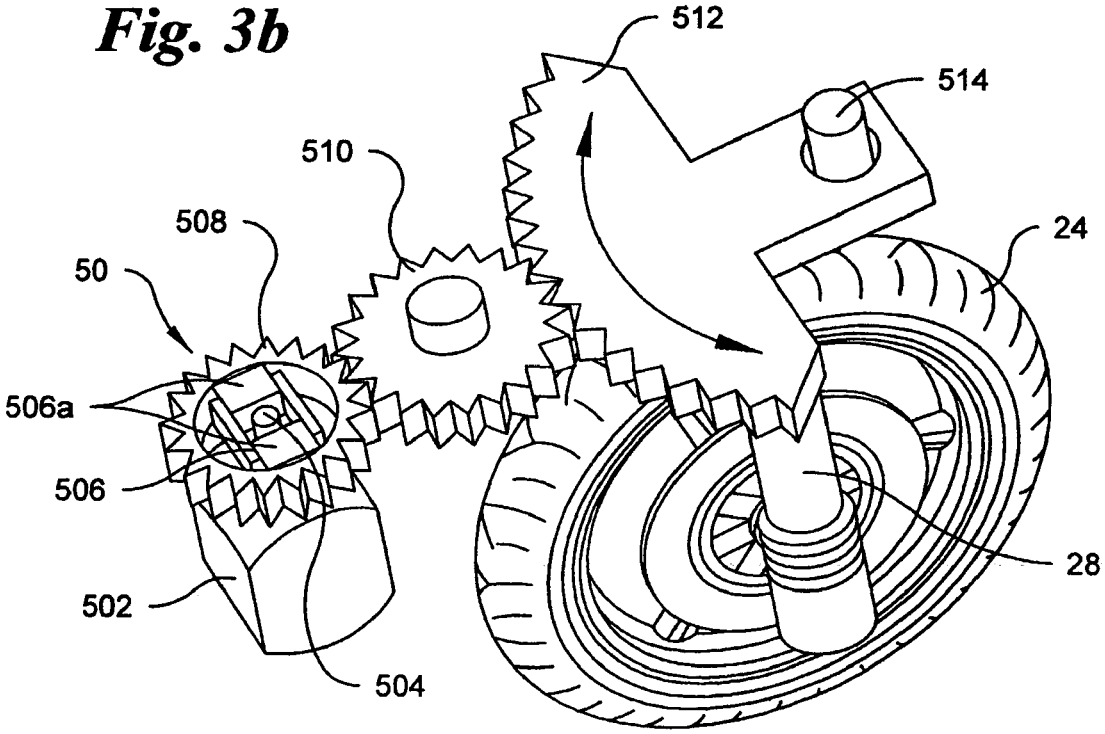

REMOTE-CONTROLLED TOY VEHICLE HAVING MULTI-MODE DRIVE MECHANISM

CROSS-REFERENCE TO RELATED APPLICATIONS

This application claims the benefit of U.S. Provisional Patent Application No. 60/543,760, filed Feb. 11, 2004, and U.S. Provisional Patent Application No. 60/576,273, filed Jun. 2, 2004, each of which is entitled "Remote-Control Toy Vehicle with Dual-Mode Drive Mechanism."

BACKGROUND OF THE INVENTION

The present invention relates generally to remote-controlled toy vehicles, and, more particularly, to a remote-controlled toy motorcycle having a drive mechanism configured to operate in at least two modes.

Two-wheeled remote-controlled toys (i.e., motorcycles) are generally known. U.S. Pat. No. 6,095,891 discloses a two-wheeled wireless controlled toy motorcycle with improved stability in which a four-bar steering mechanism and a weighted gyroscopic flywheel are used to enhance the stability of the vehicle. However, this toy motorcycle operates with only one speed mode.

It would be desirable to have remote-controlled toy vehicle having more than one speed mode. That is, it would be desirable to have a drive mechanism configured to operate in at least two modes, rotating a drive wheel at a first maximum speed in a first mode and at a second maximum speed in a second mode, wherein the first maximum speed is different from the second maximum speed.

BRIEF SUMMARY OF THE INVENTION

Briefly stated, in one aspect, the present invention is a remote-controlled toy vehicle having a first end and a second end. The toy vehicle comprises a plurality of road wheels supporting the toy vehicle for movement across a support surface. A driving motor is selectively reversible between first and second directions of rotation. A drive mechanism drivingly connects the driving motor to at least one of the plurality of road wheels, such that operation of the driving motor in either of the first and second directions of rotation causes rotation of the at least one road wheel to propel the toy vehicle in only a forward vehicle direction.

In another aspect, the present invention is a remote-controlled toy vehicle having a first end and a second end. The toy vehicle comprises a plurality of road wheels supporting the toy vehicle for movement across a support surface. A drive output is drivingly coupled with at least one road wheel of the plurality of road wheels to rotate the at least one road wheel. A first motor is coupled with the drive output through a first train. A second motor is coupled with the drive output through a second train. Each of the first and second motors are selectively reversible between first and second directions of rotation. Selective rotation of one motor of the first and second motors in the first rotational direction while the other motor of the first and second motors is unpowered causes rotation of the at least one road wheel to propel the toy vehicle in a forward vehicle direction and rotation of the other motor in the first rotational direction of the other motor. Energization of the other motor in the second rotational direction of the other motor while the toy vehicle is traveling in a forward vehicle direction applies a resistive load to the drive output to slow the toy vehicle.

In yet another aspect, the present invention is a remote-controlled toy vehicle having a first end and a second end. The toy vehicle comprises a plurality of road wheels supporting the toy vehicle for movement across a support surface. A drive output is drivingly coupled with at least one road wheel of the plurality of road wheels to rotate the at least one road wheel. A first motor is coupled with the drive output through a first train. A second motor is coupled with the drive output through a second train. Each of the first and second motors are selectively reversible between first and second directions of rotation. Selective rotation of either of the first and second motors in the first rotational direction while the other motor of the first and second motors is unpowered causes rotation of the at least one road wheel to propel the toy vehicle in a forward vehicle direction and rotation of the other motor in the first rotational direction of the other motor.

BRIEF DESCRIPTION OF THE SEVERAL VIEWS OF THE DRAWINGS

The forgoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings:

FIG. 3*a* is a left front perspective view of a steering mechanism of the toy vehicle of FIG. 1;

FIG. 3*b* is a right rear perspective view of the steering mechanism of FIG. 3*a;*

DETAILED DESCRIPTION OF THE INVENTION

Figure 2:
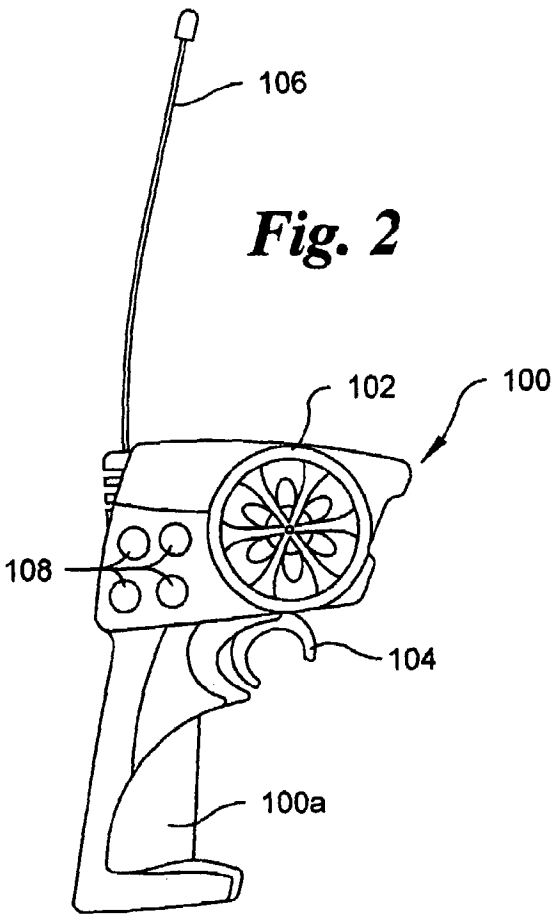
FIG. 2 is a right side elevational view of a remote control unit for use with the toy vehicle of FIG. 1.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Referring to the drawings in detail, wherein like numerals indicate like elements throughout, there is shown in FIGS. 1–5*c* a preferred embodiment of a toy vehicle 10 in accordance with present invention.

Figure 1:
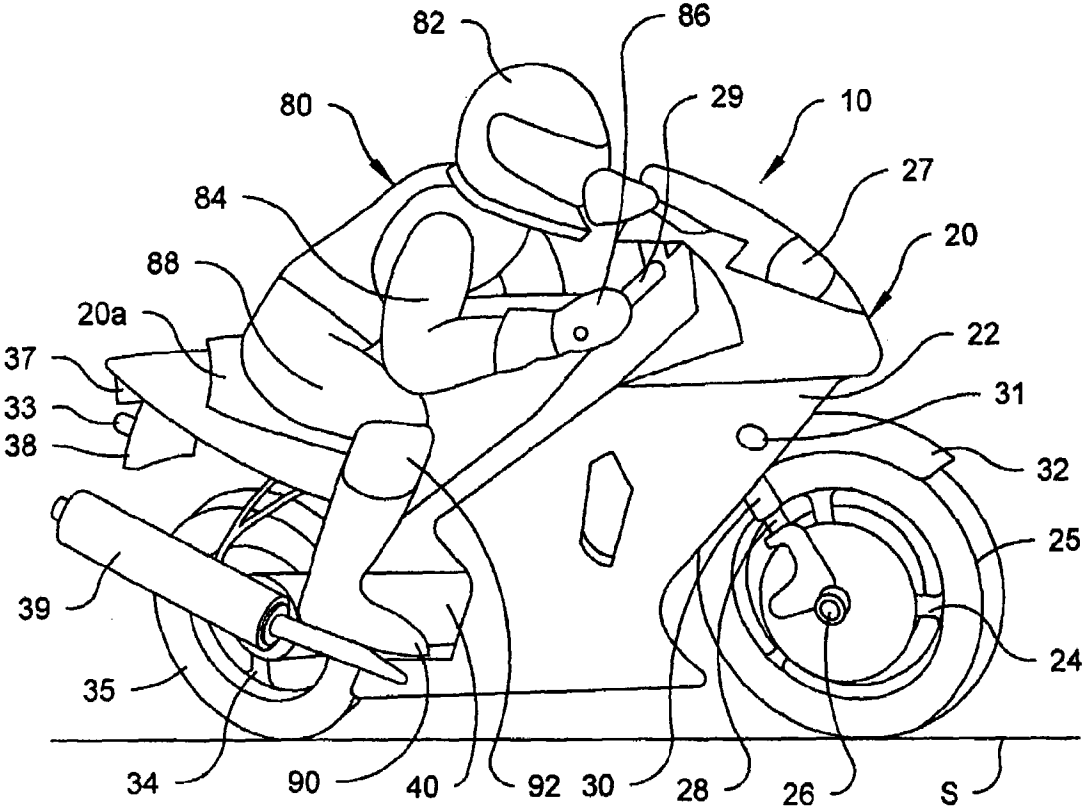
FIG. 1 is a right perspective view of a toy vehicle in accordance with a first preferred embodiment of the present invention.
Figure 6:
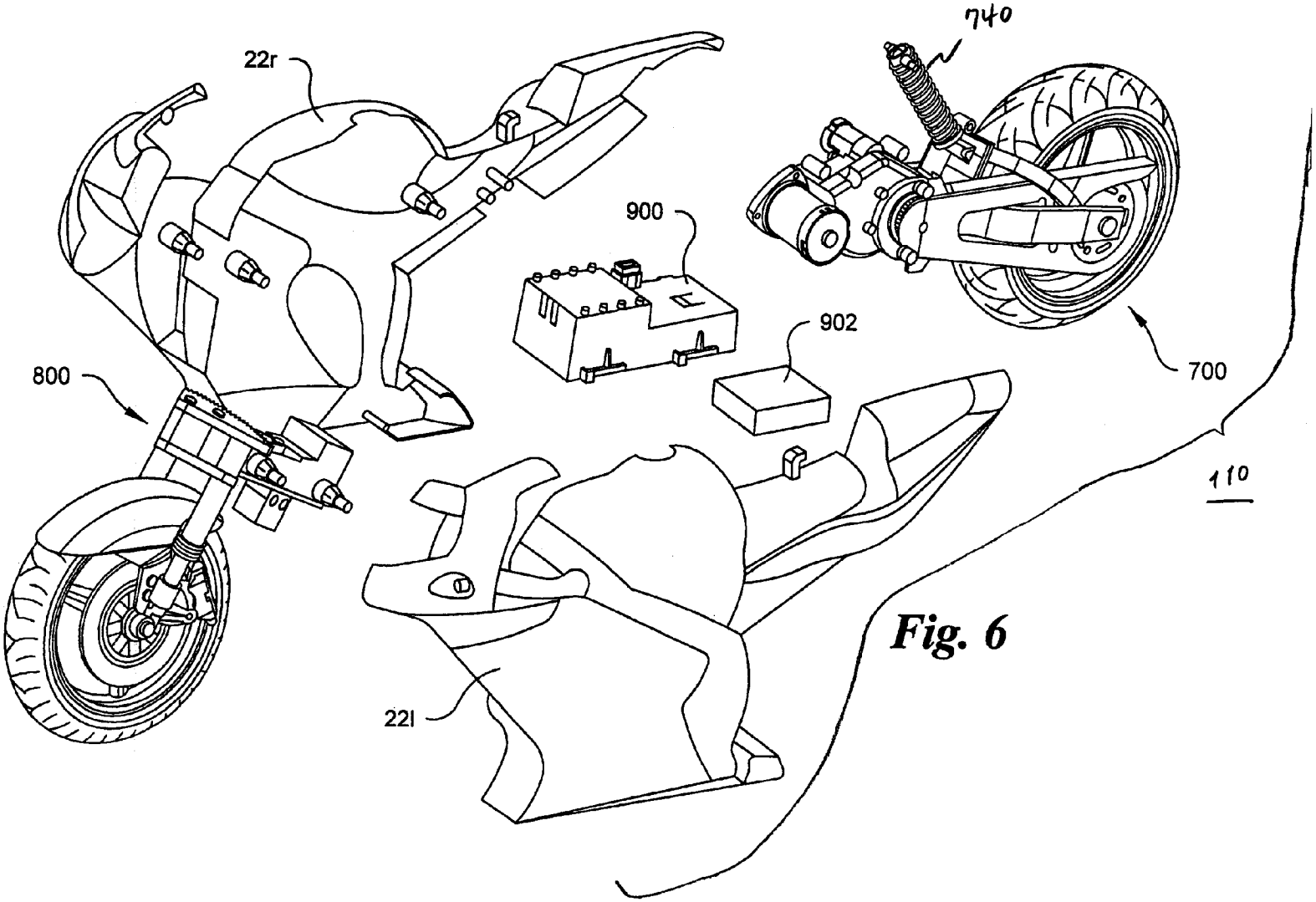
FIG. 6 is an exploded view of a toy vehicle in accordance with a second presently preferred embodiment of the invention.

Referring to FIG. 1, the toy vehicle 10 having a first end 10*a* and a second end 10*b* comprises a vehicle body 20 and a rider 80 attached thereto. Although it is preferable that the vehicle body 20 is made to look like a motorcycle, it is within the spirit and scope of the present invention that the vehicle body 20 be shaped to look like another type of vehicle, including a scooter, a car, or a truck, for instance. The vehicle body 20 has a housing 22, preferably formed from plastic to replicate the styling of a racing motorcycle. Preferably, the housing 22 is made up left and right shells 22*l*, 22*r* (FIG. 6) attached to a support frame 23 and/or to one another using attachment members, such as screws, bolts, rivets, and/or glue. Although a frame and body arrangement is shown, it is within the spirit and scope of the present invention that the housing 22 be of a monocoque construction without a separate frame. At the top of the housing 22, located between the front and back ends of the housing 22, is a seat 22*a* on which the rider 80 is positioned. The vehicle body 20 may also include various lights including a front light 27, a rear brake light 37, and front and back turn signals 31, 33.

Referring to FIG. 1, the rider 80 is shaped to look like an actual rider of a motorcycle. The rider 80 has a head 82, arms 84, hands 86, legs 88, and feet 90. The rider 80 is seated atop the housing 22 at the seat 22*a* with its legs 88 extending generally downwardly along the sides of the housing 22. The arms 84 extend generally frontwardly such that the hands 86 grasp handlebars 29, which are non-rotatably engaged with the top of the housing 22, proximate its front. The feet 90 of the rider 80 are engaged with the sides of the housing 22 proximate the middle of the housing 22. The legs 88 of the rider 80 have skid surfaces 92 in the form of knee pads that are spaced outwardly from the sides of the housing 22. When the toy vehicle 10 is turned, the skid surfaces 92 contact the ground or support surface S and slide along it to maintain the toy vehicle on its wheels 24, 34, thereby helping to prevent the toy vehicle 10 from tipping over. Although it is preferable that the skid surfaces 92 be in the form of knee pads on the rider 80, it is within the spirit and scope of the present invention that the skid surfaces 92 be in the form of wings (e.g. roll bars) extending outwardly from the sides of the vehicle body 20.

A rear swing arm 40 is pivotably attached proximate the bottom of the middle of the housing 22 and/or the support frame 23. The swing arm 40 extends rearwardly from its connection point with the housing 22 and/or the support frame 23, forming a yoke-like arm having left and right sides. Engaged between the left and right sides of the swing arm 40 is a rotatable back axle 36. A back wheel 34 preferably is fixedly engaged with the back axle 36 to be rotated by the back axle 36. A back tire 35 is wrapped around an outer edge of the back wheel 34. The front and back tires 25, 35 are preferably rubber or a soft polymer so as to increase traction and improve control of the toy vehicle 10. Extending generally upwardly from the top of swing arm 40, located in front of the back wheel 35, is a shock absorber (not shown). The upper end of the shock absorber engages with the interior of the housing 22 and/or the support frame 23 just beneath the seat 20*a*. The shock absorber acts as a rear suspension for the toy vehicle 10. A back fender 38 extends generally downwardly from proximate the back of the housing 22 and generally above the back wheel 34. A non-functional tail pipe 39 extends generally rearwardly.

Referring to FIGS. 1, 3*a* and 3*b*, a fork 28 is pivotably attached proximate the front of the support frame 23, the arms of which extend generally downwardly from proximate the front of the housing 22. A front axle 26 is engaged between the tower ends of the arms of the fork 28 proximate their bottoms. A front wheel 24 is rotatably mounted on the front axle 26. A front tire 25 is wrapped around the front wheel 24. Preferably, the arms of the fork 28 are telescopic and each has a spring 30 to allow the sliding movement of the bottom of the fork 28 with respect to the top of the fork 28 so as to act as a front suspension for the toy vehicle 10. Engaged with the fork 28 and positioned to partially cover the top of the front wheel 24 and the front tire 25 is a front fender 32.

Referring to FIGS. 3*a* and 3*b*, a steering mechanism 50 is used to pivot the fork 28 and the front wheel 24 in order to steer the toy vehicle 10. The steering mechanism 50 is located within the housing 22 proximate the front, and preferably is engaged with the support frame 23. The steering mechanism 50 comprises a steering servo 502 or actuator which rotatably drives a steering shaft 504 extending outwardly from the steering servo 502. Engaged with the steering shaft 504 is a clutch 506 having two diametrically opposed slidable feet 506*a*. A clutch gear 508 is rotatable about but not directly driven by the steering shaft 504. Rotation of the clutch 506 by the steering servo 502 causes the feet 506*a* to slide radially outwardly due to centripetal force imparted by the rotation. The feet 506*a* frictionally engage an interior surface of the clutch gear 508, thereby imparting rotation to the clutch gear 508. The clutch gear 508 engages with a spur gear 510, which is in turn engaged with a sector gear 512. The sector gear 512 is fixedly engaged with the fork 28 and is pivotable about a pivot 514 formed on a forwardmost extension 23*a* of the fork 23. An upper fork mount 516 is fixedly engaged with the upper ends of the arms of the fork 28, above the sector gear 512, and is also pivotable about the pivot 514. The upper ends of the arms preferably also extends through the web of sector gear 512 as indicated in FIG. 3*a*. Actuation of the steering servo 502 causes clockwise or counterclockwise rotation of the sector gear 512 to pivot the fork 28 about the pivot 514 located in front of the fork 28, thereby turning the front wheel 24 right or left, respectively.

Steering is accomplished by commanding the steering servo 502 to rotate continually clockwise or counterclockwise. When the steering servo 502 is not driving, forward motion of the toy vehicle 10 with the castor mounting of the front wheel 24 and fork 28 causes the front wheel 24 and fork 28 to center themselves in a neutral steering position with the front wheel 24 aligned with the longitudinal centerline of the toy vehicle 10. The clutch 506 prevents damage to the steering servo 502 when the fork 28 and sector gear 512 reach the end of their travel and also in case of binding of the steering mechanism 50. When further pivoting of the front wheel 24 and/or the fork 28 is not possible, continued actuation of the steering servo 502 causes the clutch 506 to slip within the clutch gear 508 to allow continued actuation of the steering servo 502 without the steering servo 502 becoming overburdened and potentially burning out.

Figure 4:
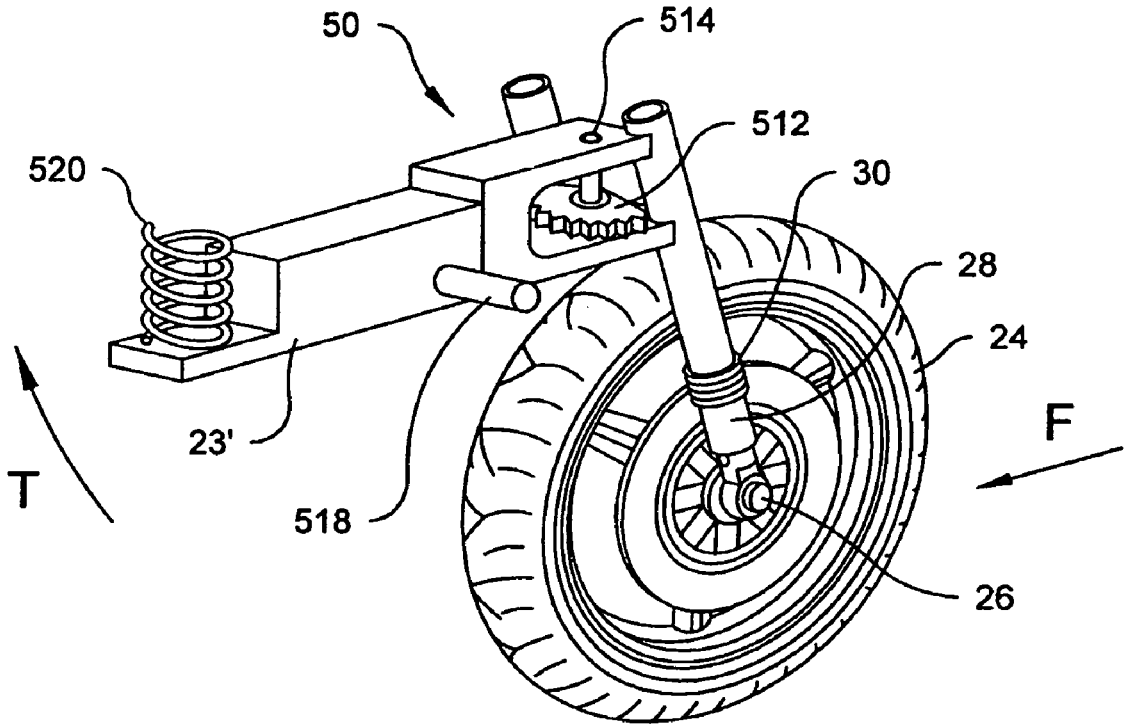
FIG. 4 is a right rear perspective view of a simplified depiction showing the mounting of the steering mechanism of FIG. 3*a* to a pivot block.

Referring specifically to FIG. 4, the steering mechanism 50, as well as the fork 28, the springs 30, the front wheel 24, and the front axle 26 (hereinafter referred to collectively as "the steering assembly"), can be pivotably mounted to a support frame 23 (or to the housing 22 if a frame is not used) via pivot pins 518. One pivot pin 518 is located on each side of the steering assembly, preferably through a pivot block 23', which supports the steering mechanism 50 and fork 28 with the front wheel 24 for movement by the steering mechanism 50. A compression spring 520 is disposed rearward of the pivot pins 518 between the top of the steering mechanism 50 and a portion of the support frame 23 (or housing 22) immediately adjoining the steering mechanism 50. Although a compression spring 520 is illustrated, it will be appreciated that other biasing arrangements could be substituted, as could other cushioning devices, such as a fluid shock absorber.

The pivotal mounting with pivot pins 518 and the compression spring 520 or the like can help protect the steering assembly from damage in the event that the toy vehicle 10 impacts an object or other obstacle (not shown) with front wheel 24. Such an impact would cause a force to be imparted to the front wheel 24 generally along arrow F. If the pivot pins 518 and the compression spring 520 were not present, such a force would have to be absorbed by the components of the steering assembly and could result in the steering assembly components becoming broken, bent, or otherwise misaligned. However, the presence of the pivot pins 518 and the compression spring 520 allows the steering assembly to pivot about the pivot pins 518 in the direction of arrow T upon application of the force resulting from an impact along the arrow F. As the steering assembly pivots about the pivot pins 518, the compression spring 520 compresses and absorbs at least a significant portion of the energy that could be generated from the impact and, in this way, helps to protect the steering assembly from damage.

Figure 5A:
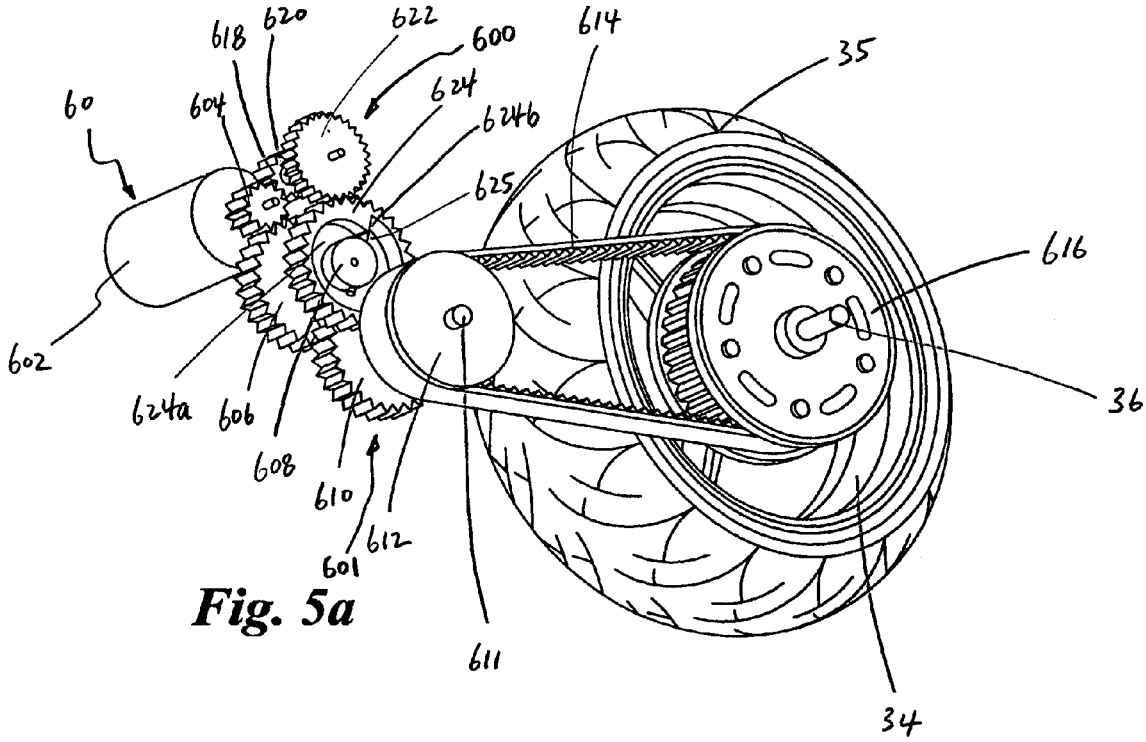
FIG. 5*a* is a left front perspective view of a drive mechanism of the toy vehicle of FIG. 1.
Figure 5B:
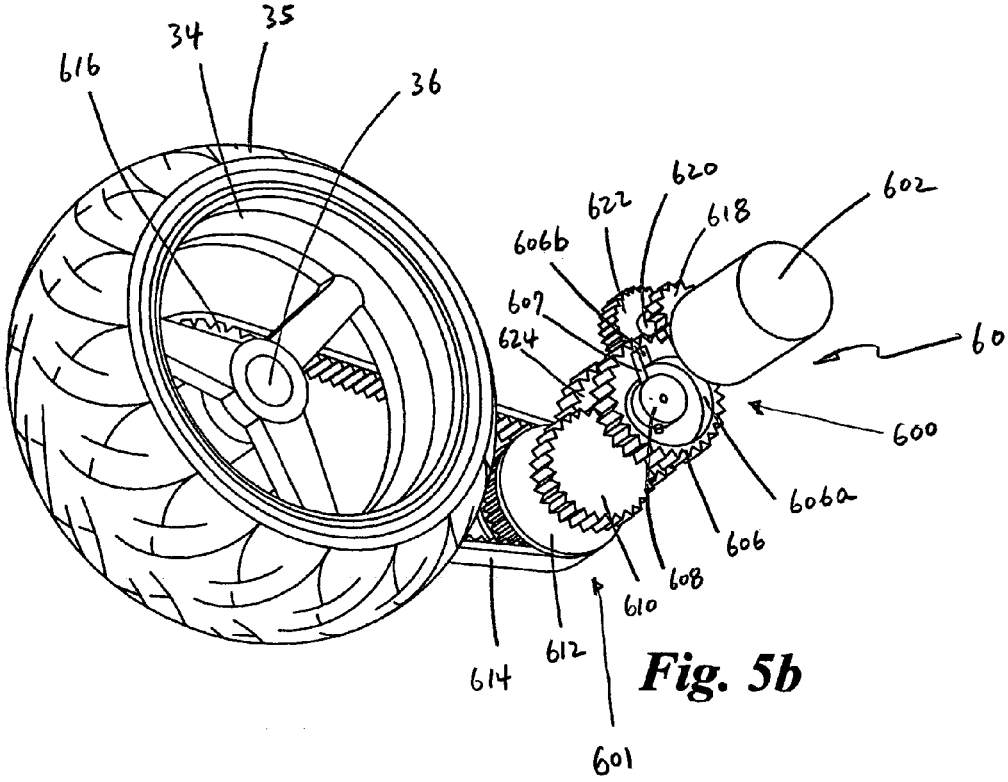
FIG. 5*b* is a right rear perspective view of the drive mechanism of FIG. 5*a;*
Figure 5C:
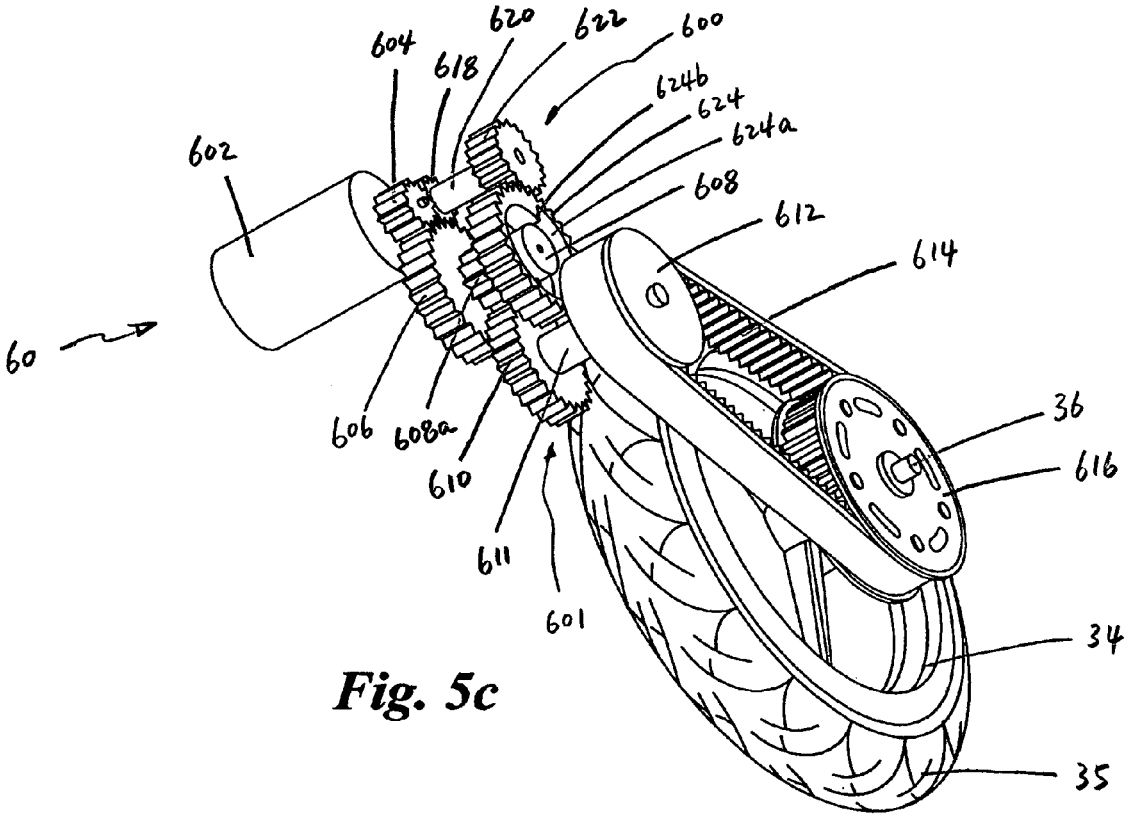
FIG. 5*c* is a bottom right perspective view of the drive mechanism of FIG. 5*a;*

Referring to FIGS. 5*a*–5*c*, the toy vehicle 10 preferably has a drive mechanism 60 disposed within the vehicle body 20, preferably supported by the support frame 23. The drive mechanism 60 imparts rotation to the back wheel 34 in order to drive the toy vehicle 10 in a forward direction.

The drive mechanism 60 preferably comprises a bi-directional electric driving motor 602 that rotates a pinion 604 which is itself engaged with a first clutch gear 606. The first clutch gear 606 rotates about a first shaft 608, which is itself rotatable. The first shaft 608 has a first catch 607 slidably engaged through a chord of a first end of the first shaft 608. The distal end of the first catch 607 extends into an interior spiral-shaped channel 606*a* in the first clutch 606. Within the channel 606*a* is an abutment 606*b* extending radially inwardly from the outermost portion of the exterior wall of the spiral-shaped channel 606*a* to connect with the innermost portion of the exterior wall of the spiral-shaped channel 606*a*. This configuration allows for the first clutch gear 606 to rotate in a first direction (a clockwise direction when viewing the first clutch gear 606 in FIG. 5*b*) without causing the first shaft 608 to rotate due to the fact that the first catch 607 only slides along the exterior wall of the channel 606*a* without becoming engaged with any part of the first clutch gear 606. However, rotation of the first clutch gear 606 in a second direction (a counterclockwise direction in FIG. 5*b*) causes engagement of the abutment 606*b* with the first catch 607, thereby engaging the first clutch gear 606 with the first shaft 608 to impart rotation to the first shaft 608.

Rotation of the first shaft 608 causes a central drive gear 608*a* (FIG. 5*c*), fixedly mounted to the first shaft 608 proximate the center of the first shaft 608 between the first clutch gear 606 and a second clutch gear 624, to rotate. The central drive gear 608*a* in turn engages and causes the rotation of a first spur gear 610. The first spur gear 610 is fixedly engaged with a first end of a second shaft 611, such that rotation of the first spur gear 610 causes rotation of the second shaft 611. A second end of the second shaft 611 is fixedly engaged with a first pulley 612 or drive output, whereby rotation of the first spur gear 610 causes rotation of the first pulley 612 in the same direction as that of the first spur gear 610. The combination of elements 610, 611 and 612 collectively constitute a drive output indicated generally at 601. Rotation of the first pulley 612 causes rotation of a second pulley 616 due to a belt 614 that is wrapped around the first and second pulleys 612, 616. The second pulley 616 is fixedly engaged with a portion of the back axle 36, rotation of which causes rotation of the back wheel 34, engaged with another portion of the back axle 36, so as to drive the toy vehicle 10 in a forward direction.

Also engaged with the pinion 604 is a second spur gear 618, which is fixedly engaged with a third shaft 620 to rotate the third shaft 620. It is understood, however, that the second spur gear 618 could alternatively be driven by the first clutch gear 606 without otherwise changing the structure or operation of the drive mechanism 60. The third shaft 620 is also fixedly engaged with a third spur gear 622, such that rotation of the second spur gear 618 causes rotation of the third spur gear 622 in the same direction as that of the second spur gear 618. The pinion 604, second spur gear 618, third shaft 620 and third spur gear 622 are collectively referred to as a driving train 600. The third spur gear 622 is engaged with the second clutch gear 624. The second clutch gear 624 is rotatably engaged with a second end of the first shaft 608, oppositely disposed on the first shaft 608 from the first clutch gear 606. The structure of the second clutch gear 624 is essentially similar to and preferably a mirror image of the first clutch gear 606, in that it has a spiral-shaped channel 624*a* and an abutment 624*b*. Also, the second end of the first shaft 608 has a second catch 625 slidably extending through a chord of the second end of the first shaft 608. The second clutch gear 624 is configured such that when rotated in the first direction (a counterclockwise direction when the second clutch gear 624 is viewed in FIG. 5*a*), the catch 625 slides within the channel 624*a* and fails to engage the second clutch gear 624 resulting in slippage between the second clutch gear 624 and the first shaft 608. However, rotation of the second clutch gear 624 in the second direction (a clockwise direction in FIG. 5*a*) causes engagement of the abutment 624*b* and the catch 625 so as impart rotation to the first shaft 608. This, in turn, causes rotation of the gear portion 608*a* of the first shaft 608 and, in the manner described above, ultimately rotates the back wheel 34 in order to drive the toy vehicle 10 in a forward direction.

Due to the above-described configuration of the drive mechanism 60, both clutch gears 606, 624 rotate while the driving motor 602 is actuated, regardless of the direction in which the driving motor 602 is actuated. However, due to the orientation of the first and second clutch gears 606, 624, when one of the clutch gears 606, 624 is rotated in the first, engaging direction, the other clutch gear 624, 606 is rotated in the second, slipping direction. Therefore, the first and second clutch gears 606, 624 cannot be rotated in the first engaging direction at the same time. In this way, regardless of the direction of actuation of the driving motor 602, the back wheel 34 is always rotated to drive the toy vehicle 10 in the forward direction. However, because of the configuration of the drive mechanism 60, in addition to the first clutch gear 606 being rotated in an opposite direction to that of the second clutch gear 624, the first clutch gear 606 is also rotated at a slower speed than that of the second clutch gear 624 due to the speed-increasing combination of the second and third spur gears 618, 622. In this way, the drive mechanism 60 is capable of dual-mode operation, enabling the toy vehicle 10 to be run in two modes: (1) a first "normal" mode when the driving motor 602 is rotated in a first drive direction (counter clockwise rotation of pinion 604 in FIG. 5*c*), which rotates the first clutch gear 606 in the first, engaging direction, and (2) a second "turbo" mode when the driving motor 602 is rotated in a second drive direction (clockwise rotation of pinion 604 in FIG. 5*c*) to cause the second clutch gear 624 to rotate in the first, engaging direction. This results in the back wheel 34 being rotated faster in the second "turbo" mode than in the first "normal" mode. The driving motor 602 is electronically controlled by reversing the direction of current while maintaining the same voltage.

Referring now to FIG. 2, an exemplary controller 100 has a pistol grip handle 100*a* which is grasped by a user. The controller 100 is used by the user to remotely control the movement of the toy vehicle 10. The controller 100 preferably has bi-directional trigger 104, which preferably controls the forward motion and braking of the toy vehicle 10, and a rotational knob 102, which preferably controls the steering of the toy vehicle 10. The controller 100 also includes buttons 108, which can be used to control other aspects of the toy vehicle 10, as is described below. The controller 100 further has an antenna 106 extending upwardly from the top of the controller 100. The controller 100 is preferably powered using AA batteries (not shown) located within the handle 100*a*.

The buttons 108 can be used to control other functions of the toy vehicle 10, such as lighting of the front and back lights 27, 37; the lighting of the turn signals 31, 33; or the production of sound effects from a speaker (not shown) disposed within the toy vehicle 10. Sound effects could include the sound of an idling motor, a special sound for actuation of "turbo" mode, a horn sound, and a squealing tire sound. Alternatively, actuation of certain lights and/or sound effects could be accomplished by actuation of either the steering control or the drive motor control. For instance, movement of the trigger 104 in the second direction to drive the toy vehicle 10 in the "turbo" mode could automatically initiate the production of the turbo sound effect from the speaker. In the same way, the transmission of a steering command by actuation of the rotational knob 102 could automatically cause the production of squealing sound effects from the speaker and the appropriate lighting of the turn signals 31, 33. Lastly, the back break light 37 could be illuminated and the idling sound effect could be produced whenever the drive motor is not being actuated or when it is being braked.

A conventional on-board control unit 902 (FIG. 6) is mounted to and maintained within the housing 22 and/or the support frame 23 of the toy vehicle 10. An antenna, preferably hidden within the vehicle 10, is electrically coupled to the on-board control unit and is disposed at least partially within the rider 80 so as not to protrude from the toy vehicle 10. Also, a battery or battery pack (neither shown) housed within a battery box 900 (FIG. 6) is preferably removably engaged within the housing 22 to power the toy vehicle 10. Preferably, the battery is a rechargeable type battery. Although this is preferred, it is in the spirit and scope of the present invention that the toy vehicle 10 be powered by another type of battery or electric power source such as a quick charge capacitor. The vehicle can be powered by a non-electrical source, such as air or gasoline, but means must either be provided to reverse the output of such power source if used to drive a pinion or such power source has to drive a generator to drive a reversible electric motor. The vehicle may be configured to recharge rechargeable batteries which still in the housing.

The on-board control unit 902 is electrically coupled to the steering servo 502 and the drive motor 602 and configured to receive and process control signals transmitted from the controller 100, which is spaced from the toy vehicle 10 to remotely control movement of the toy vehicle 10 by the user. The user, if within a predetermined distance from the toy vehicle 10, will be able to remotely control the drive motor 602 to either rotate in the first drive direction (by moving the trigger 104 in a first direction), thereby propelling the toy vehicle 10 in the forward direction at a "normal" speed or in the second drive direction (by moving the trigger 104 in a second direction), thereby propelling the toy vehicle 10 in the forward direction at a "turbo" speed. The user will also be able to remotely control the steering servo 502 to pivot the front wheel 24 in either a first or a second steering (i.e. lateral) direction so as to turn the toy vehicle either right or left.

The toy vehicle 10 of the first preferred embodiment improves upon the prior art by having a dual-mode drive mechanism 60 that includes a dual speed transmission. The drive mechanism 60 allows for the toy vehicle 10 to be driven at either a first speed in a first "normal" mode or a second speed in a second "turbo" mode, the second speed being faster than the first speed at the same rotational motor speed of the driving motor (or other prime mover), and to be shifted between modes by reversing the direction of rotation of the driving motor.

Figure 7:
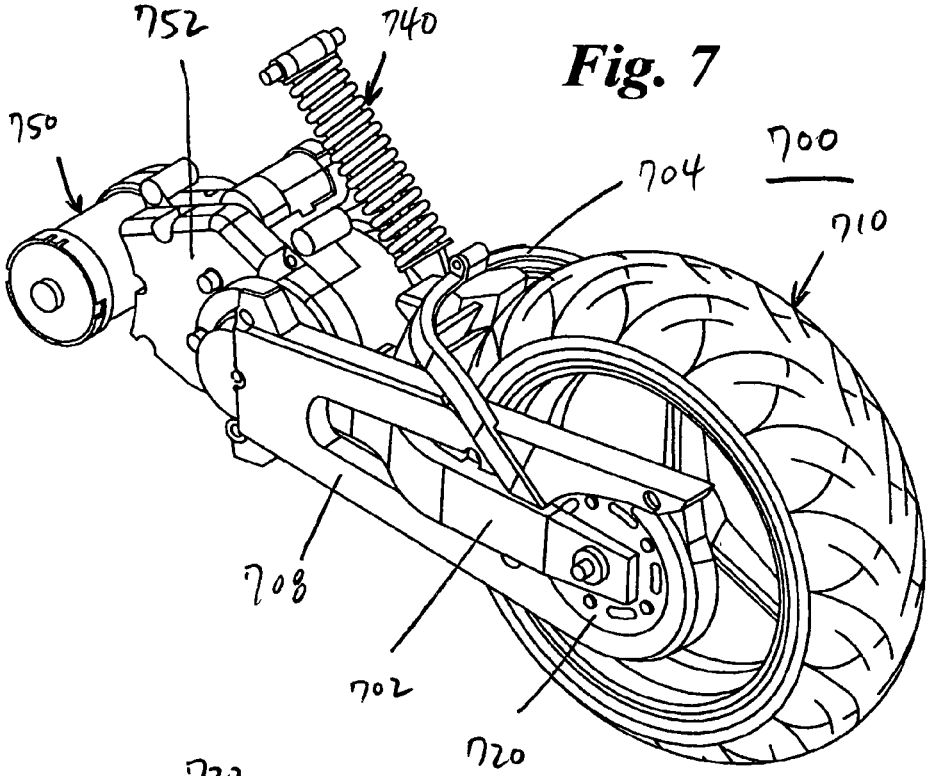
FIG. 7 is a left rear perspective view of a drive assembly of the toy vehicle of FIG. 6.
Figure 8:
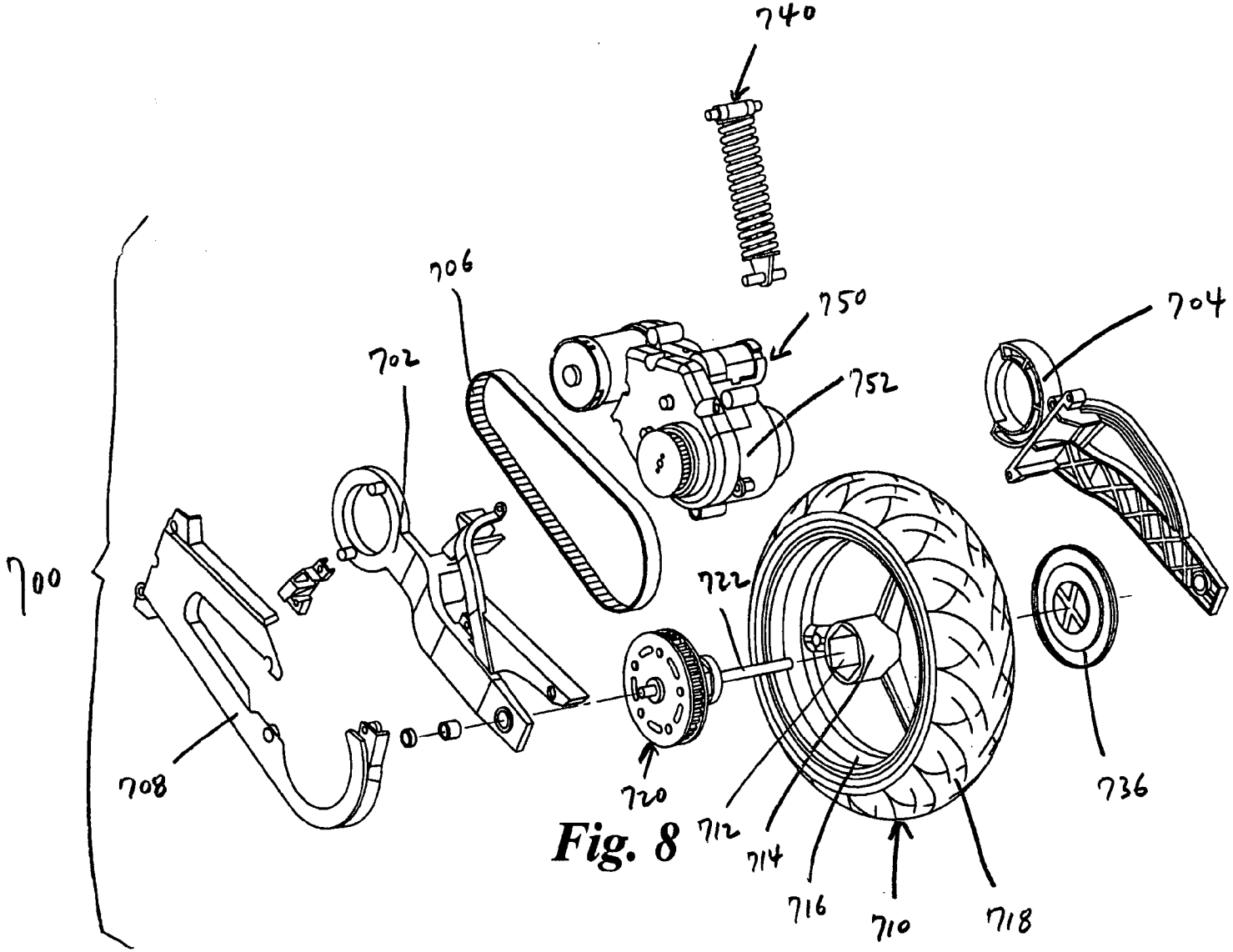
FIG. 8 is an exploded view of the drive assembly of FIG. 7.
Figure 10:
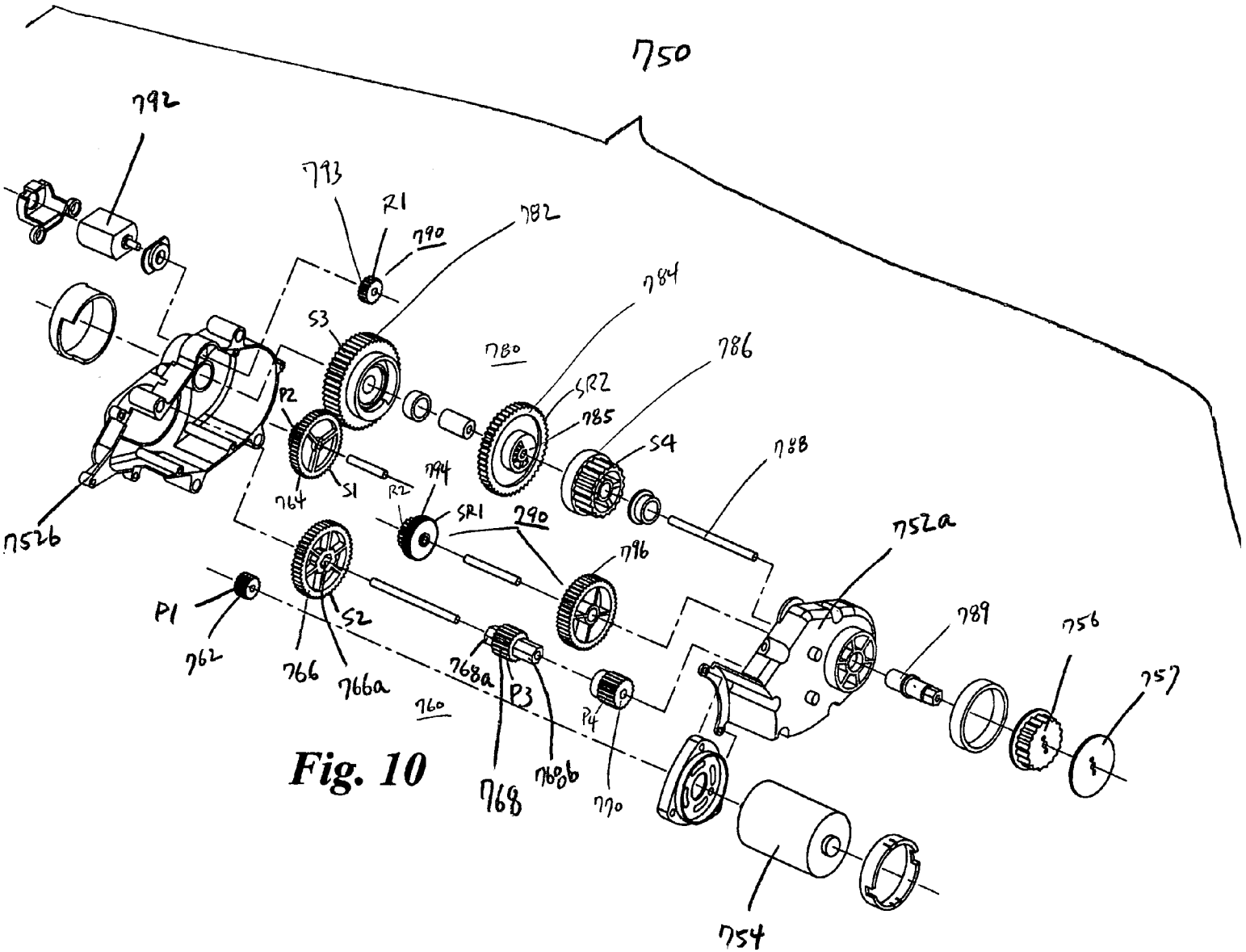
FIG. 10 is an exploded view of a drive mechanism of the drive assembly of FIG. 7.
Figure 11:
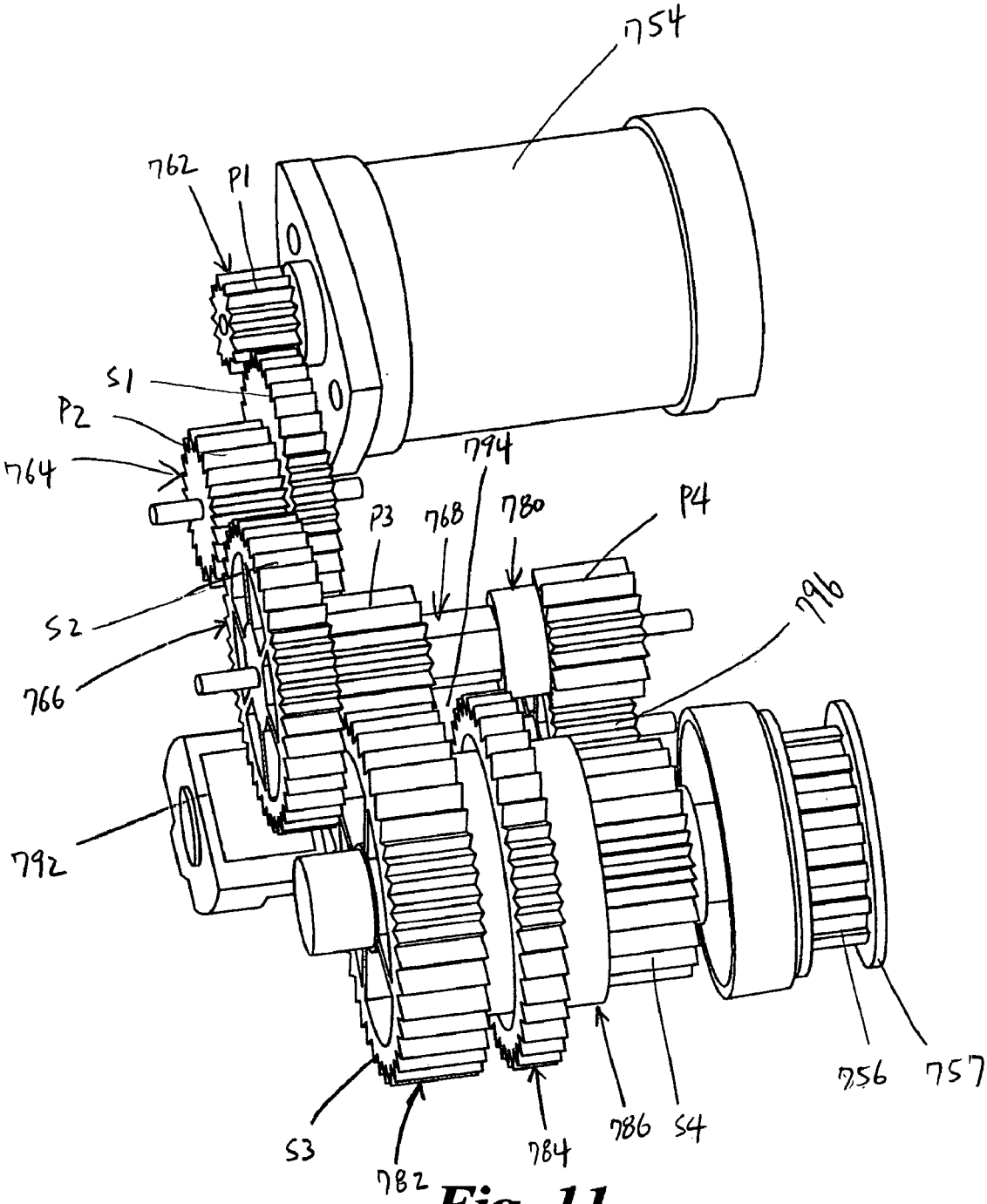
FIG. 11 is a first assembled side perspective view of a gear train of the drive mechanism of FIG. 10.
Figure 12:
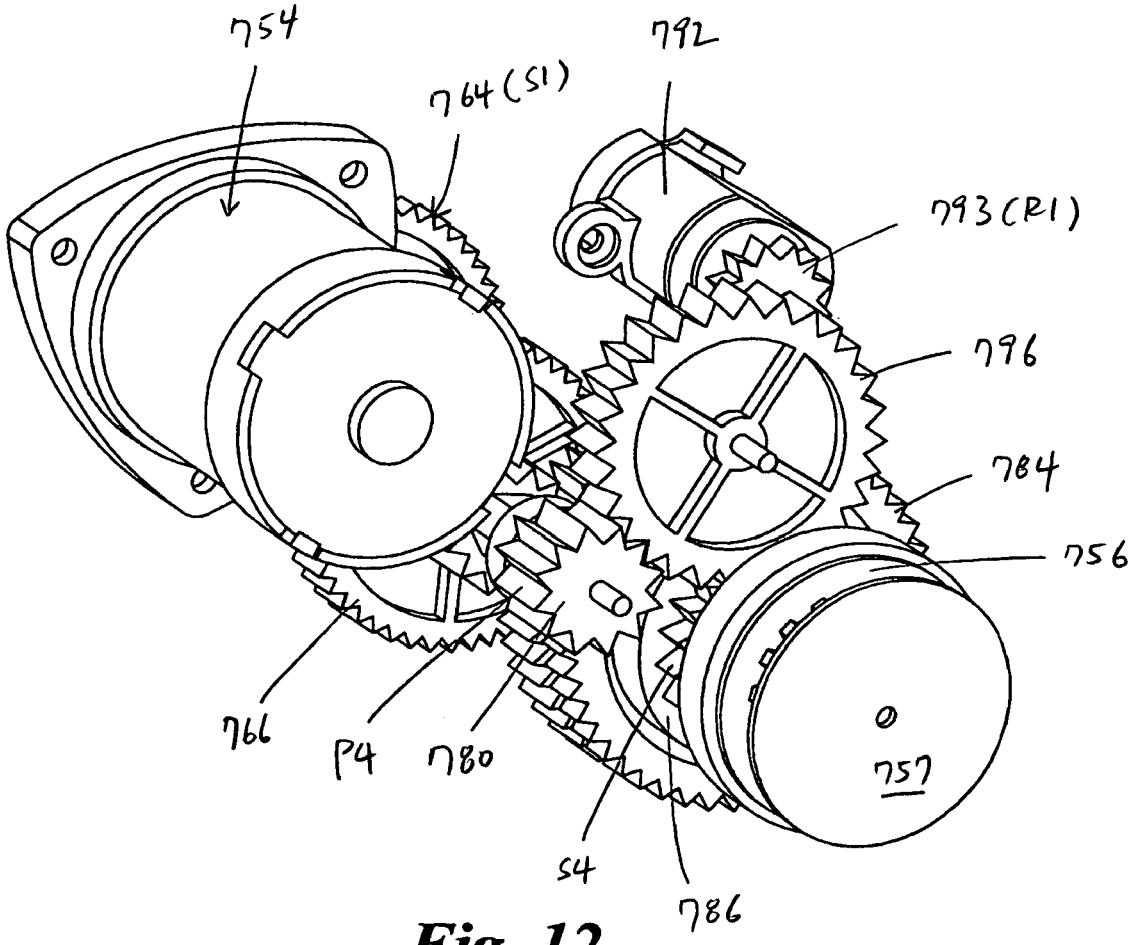
FIG. 12 is a second assembled perspective view of the gear train of FIG. 11 from an opposite side and end.
Figure 13:
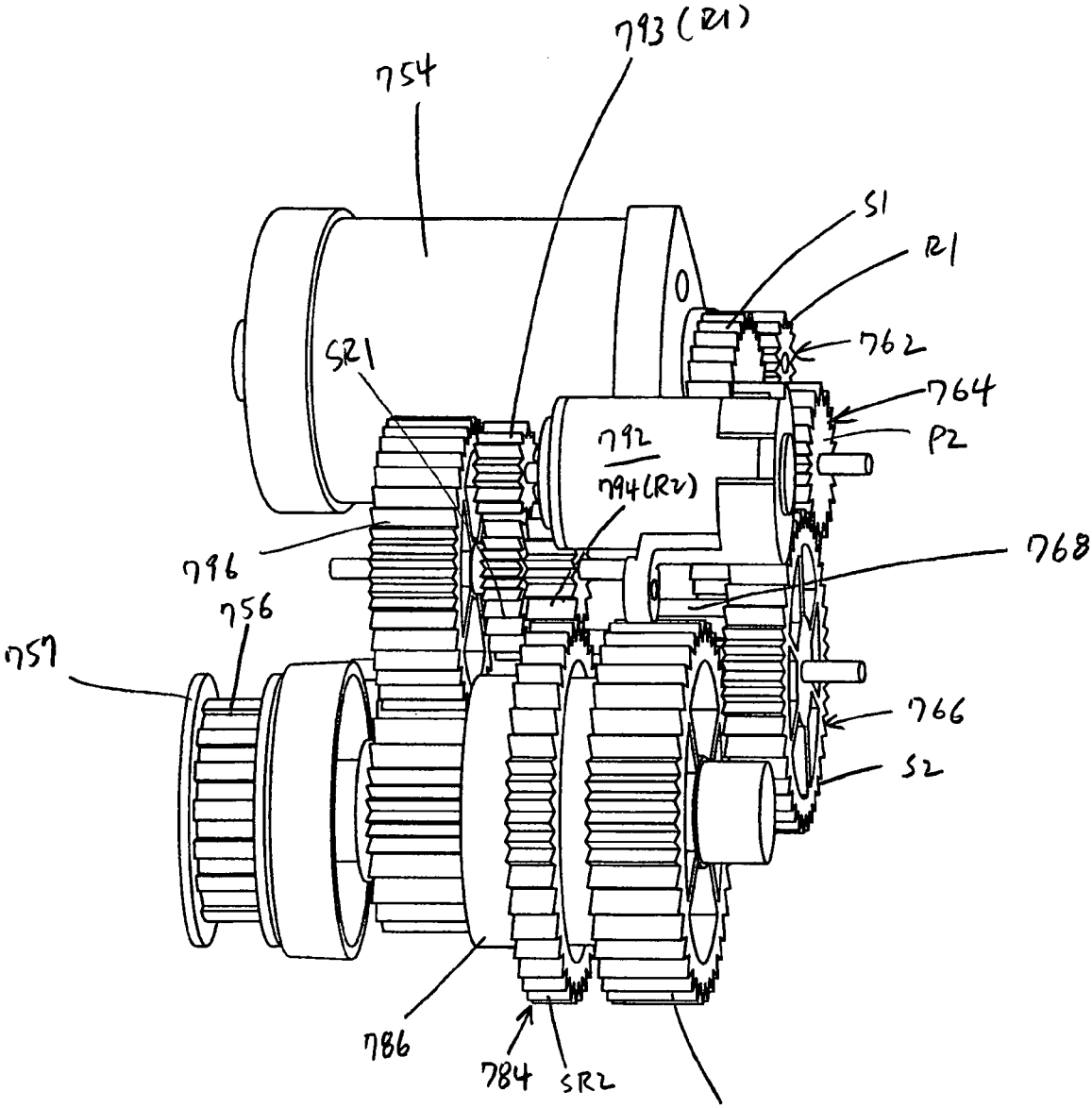
FIG. 13 is a third assembled perspective view of the gear train of FIG. 11 showing a braking portion of the gear train.

A second presently preferred toy vehicle embodiment is shown in FIGS. 6–15 and indicated generally at 110. FIGS. 7 and 8 provide detailed views of a presently preferred rear drive assembly indicated generally at 700. Assembly 700 includes mating left and right swing arms 702, 704, respectively, a flexible loop drive member 706 (preferably a timing belt) and drive loop cover 708 which mates to the left swing arm 702. Captured between the distal ends of the swing arms 702, 704 are a rear wheel assembly 710 and a rear axle assembly 720, a preferred embodiment of the latter being seen in an exploded view in FIG. 9. The swing arms 702, 704 are rotatably supported on either side of an end of the housing 752 of a rear drive mechanism 750, components of which are depicted in FIGS. 10–14*b*. A shock assembly 740 is preferably provided to resiliently support rear drive assembly 700 from the chassis or body of the motorcycle.

Figure 9:
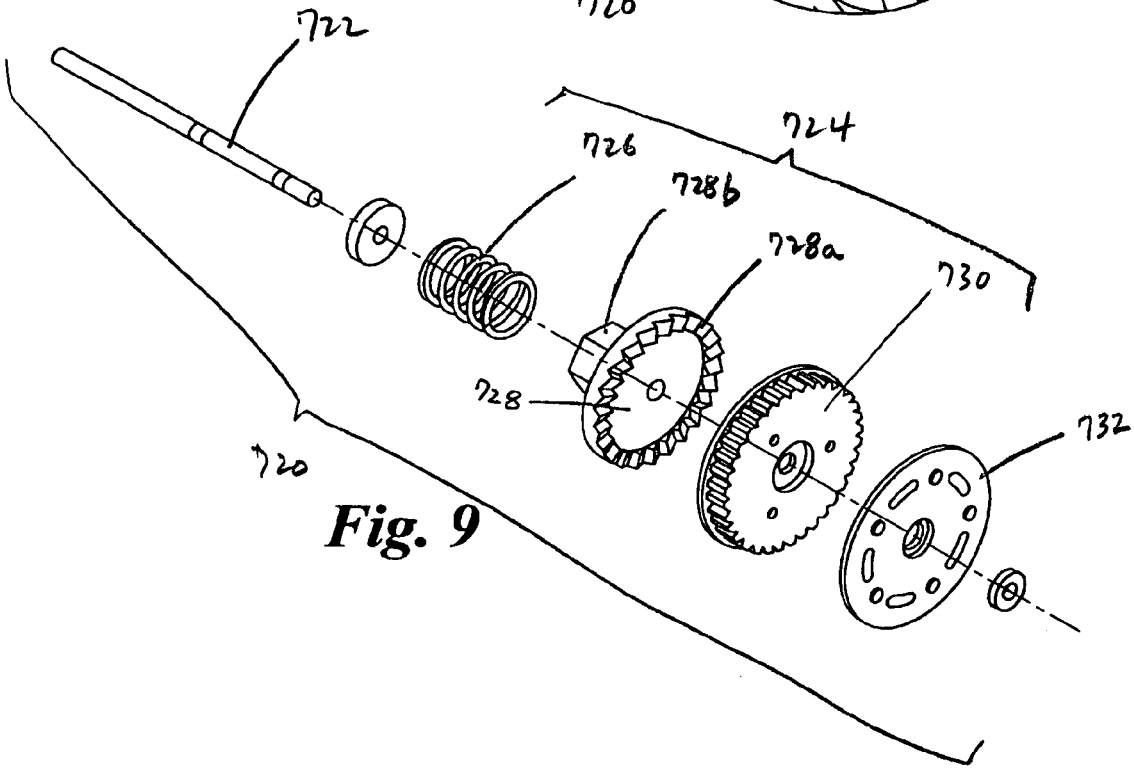
FIG. 9 is an exploded view of a rear axle assembly of the drive assembly of FIG. 7.

Turning to FIG. 9, the preferred rear axle assembly 720 includes axle 722 and a clutch sub-assembly 724 formed by a biasing member 726 which biases a first clutch member 728 against a combined second clutch/sprocket member 730. A circular cover 732 mates with the outer, sprocket side of member 730. First clutch member 728 has a ring of serrations 728*a* on the side facing the second clutch member/sprocket 730 and a male hub 728*b* protruding outwardly from the opposite side of 728 that is shaped to key into the shaped recess 712 in the center of hub 714 of rear wheel assembly 710 (see FIG. 8). Hub 714 is part of rear wheel 716 supporting rear tire 718. A brake disk simulating cover 736 (see FIG. 8) is provided on the opposite side of the rear wheel assembly 710 and receives the rear axle 722. In this way, rear axle assembly 720 is fixed with rear wheel assembly 710 for simultaneous rotation on axle 722, which is driven by the rear drive mechanism 750 through flexible loop drive member 706.

FIGS. 10–13 depict the components of and their arrangement in a presently preferred rear drive mechanism 750. The preferred mechanism is a two speed, twin engine gear box/motor combination. Housing 752 is made up of two mating shells 752*a*, 752*b*. The drive mechanism 750 is preferably provided with two motors, a first reversible driving motor 754 and a second braking motor 792. The gears of the transmission are organized in essentially three trains: a first driving train driven by the driving motor 754, a second braking train driven by the braking motor 792, and an output train 780 or drive output, which meshes with the two previous trains. The driving train is indicated generally at 760 and includes a main motor pinion (P1) 762 which drives the spur (S1) portion of a combined gear 764. A pinion (P2) portion of that gear meshes with a second spur (S2) gear 766 which has a central hub 766*a* which is configured to mate and key with an end 768*a* of another pinion (P3) 768. The P3 pinion 768 has an opposing end 768*b*, which is similarly received in an opening (hidden) of another pinion (P4) 770. In this way, gears 766, 768, 770 can be viewed as a single combined gear having spur portion (766) and a split pinion portion (768, 770). The output train or drive output 780 includes a first combined gear (S3)/clutch member 782, a double clutched braking gear 784 and a second combined gear (S4)/clutch member 786. A main shaft 788 is shaped to key into the center opening of the double clutched braking gear 784 so as to be driven by that gear. In turn, an end of the main shaft 788 keys into one end of a collared mounting shaft 789 which, in turn, has an opposing end which keys into drive sprocket 756 (with cover 757). The P3 pinion 768 meshes directly with the spur gear (S3) portion of the first combined first gear/clutch member 782. The P4 pinion 770 is engaged with spur gear portion S4 of the second combined spur gear/clutch member 786 through a reverse idler gear 796. Finally, braking motor 792 supports an R1 pinion 793 which engages the spur portion SR1 of a braking gear 794. The pinion portion R2 of braking gear 794 meshes with the teeth of the spur portion SR2 of double clutched braking gear 784. Gears 793, 794 and 796 are collectively referred to as a braking train 790. The various gears of this transmission are seen in detailed assembled views in FIGS. 11–13 to indicate their arrangement and engagement.

Figure 14A:
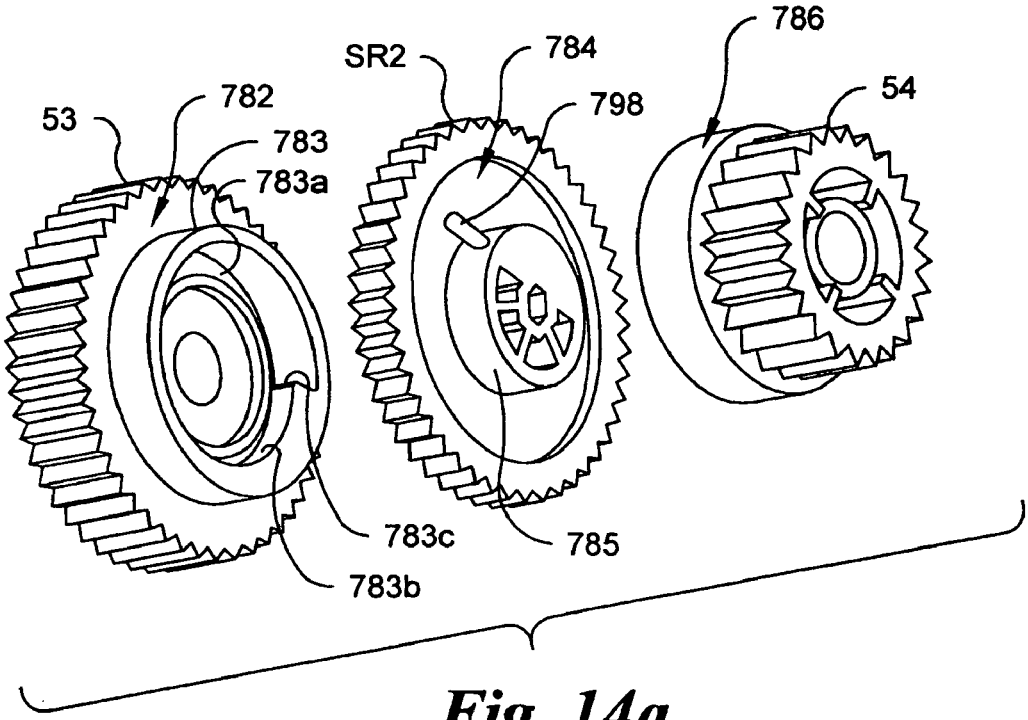
FIGS. 14*a* and 14*b* show opposite sides of a double clutch gear and the two gears with which it alternately engages, all of which are part of the gear train of FIG. 11.
Figure 14B:
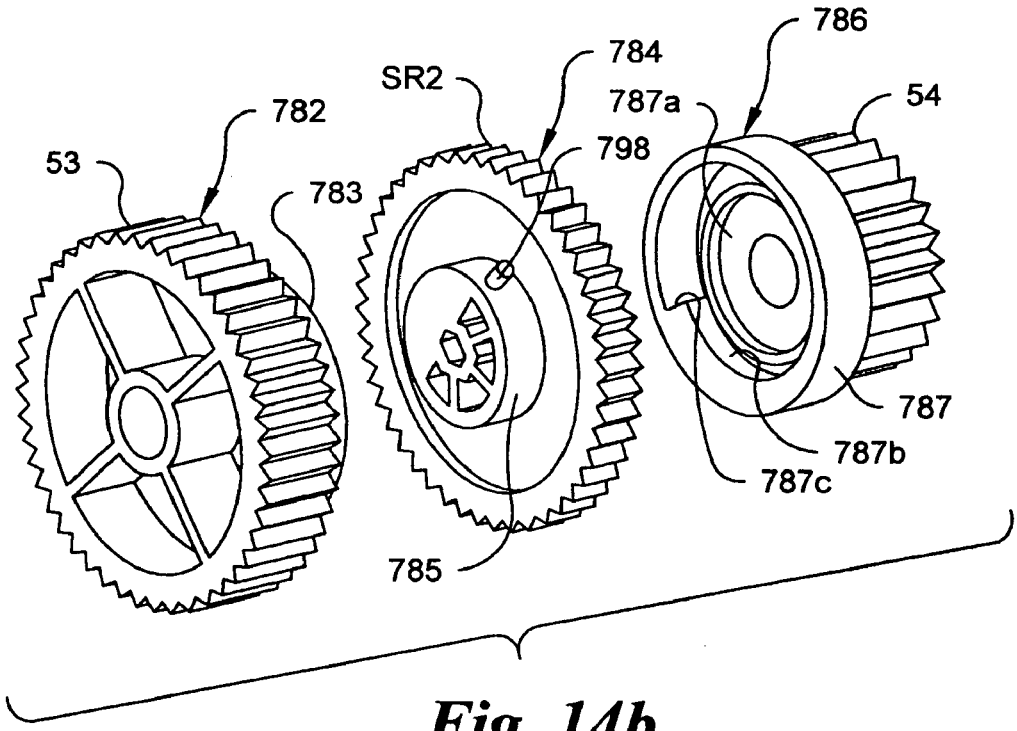

FIGS. 14*a* and 14*b* show opposite sides of the double clutched braking gear 784 with each of the first and second combined gear/clutched members 782, 786. The double clutched braking gear 784 has a central hub 785 which protrudes from both sides of the gear portion SR2. On each side of the gear 784, a chordal bore is provided through the exposed axial end of the hub 785. Each bore receives a spring loaded pin 798. Each of the combined gear/clutch members 782/786 includes a clutch member portion 783, 787, respectively, which faces one end of the hub 785, and includes a central recess 783*a*, 787*a*, respectively, which receives the facing end of the hub 785. Each recess 783*a*, 787*a* is provided with an inner ramp surface 783*b*, 787*b*, respectively, which terminates in a radially and axially extending stop surface 783*c*, 787*c*, respectively. Combined gear/clutch members 782 and 786 are constantly being driven by the P3 and P4 pinions 768, 770 as long as the driving motor 754 is powered. The drive mechanism 750 can therefore be operated in at least two modes in which the rear wheel is driven by the mechanism 750 in a forward vehicle direction, a first mode in which the driving motor is operated in a first direction of rotation and the drive mechanism provides a first drive ratio between the driving motor and the rear wheel and a second mode in which the driving motor operates in a second, opposite rotational direction and the drive mechanism provides a second drive ratio, different from the first ratio, between the driving motor and the rear wheel. Consequently, when the driving motor is driven in the first rotational direction at a first motor rotational speed, the rear wheel rotates in the forward vehicle direction at a first speed and when the driving motor is driven in its second rotational direction but at the same first motor rotational speed, the rear wheel rotates in the forward vehicle direction at a second speed different from the first speed. Depending upon which direction the driving motor 754 is driven, one of the pinion-combined gear/clutch member pairs 768–782 or 770–786 will be drivingly engaged with the double clutched braking gear 784. Also, depending on which direction the driving motor 754 is driven, the maximum speeds differ due to the difference in size of the driving elements 768 and 796 which drive first and second clutched members 782, 786, respectively, and resulting difference in drive ratios. However, regardless of the driving direction of motor 754, the braking gear 784 would be driven in one direction (counterclockwise in FIG. 14*a* and clockwise in FIG. 14*b*) to drive the rear wheel assembly 710 in a forward propelling direction of the vehicle 110. Braking motor 792 is powered by the control circuitry of the vehicle 110 to rotate in an opposite direction to the direction of rotation of the braking gear 784 to add a resistive load to that gear to more quickly slow down the vehicle 10. Of course, it should be appreciated that since the second, "braking" motor 792 is always engaged with the output train 780, it can also be controlled to be driven in a second motor rotational direction opposite its first "braking" motor rotational direction and drive the rear wheel in the forward vehicle direction, thereby providing a third mode of operation and a third drive ratio, of the drive mechanism between a motor and the driven rear wheel. Such third mode of operation could be controlled remotely by another button (not depicted) on the controller.

Figure 15:
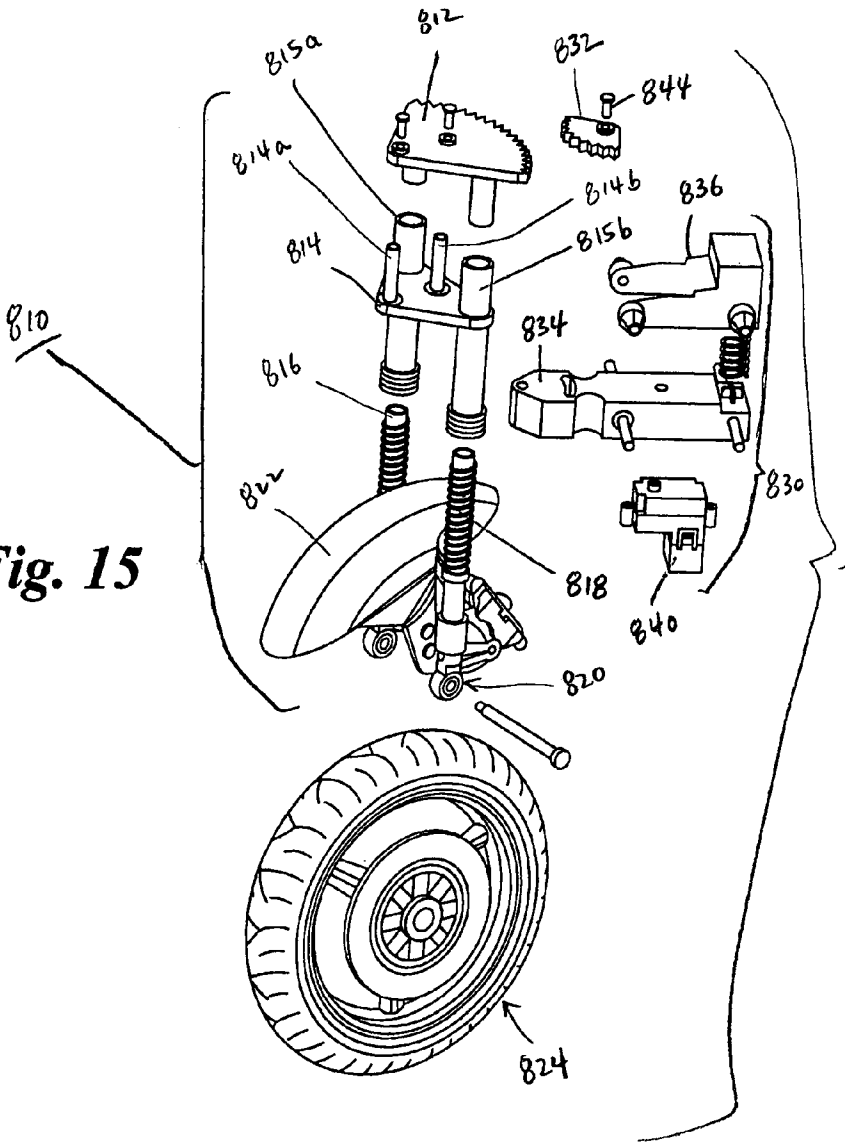
FIG. 15 is an exploded view of a steering assembly of the toy vehicle of FIG. 6.

Turning now to FIG. 15, there is shown a detailed view of a presently preferred steering mechanism in the form of an assembly indicated generally at 800. The steering assembly 800 includes a fork assembly indicated generally at 810. A driven sector gear 812 is fixedly mated to an upper fork mount 814. Mount 814 includes a pair of upper forks 815*a*, 815*b*, respectively, the lower ends of which receive upper ends of identical fork shafts 816. Lower ends of the fork shafts 816 are received in lower fork mounts 820. A suspension biasing member in the form of a coil spring 818 is mounted on each of the fork shafts 816. Mounted between fork shafts 816 and lower fork mounts 820 are front fender 822 and a front wheel assembly 824, which is supported for free rotation by the steering mechanism assembly 800 through a front axle 826 received through the lower fork mounts 820. The steering mechanism/assembly 800 is operably coupled with and pivoted by a servo assembly 830, which is preferably pivotally mounted between the driven sector gear 812 and the top of the upper fork mount 814 on pins 814*a*, 814*b*, respectively. The servo assembly 830 includes a driving sector gear 832, an upper fork mount 834, an upper fork mount cover 836 and a biasing member/spring 838 trapped between the upper fork mount 834 and cover 836. Finally, a steering servo 840 is fixedly secured in a suitably configured recess (not seen) in the bottom of the upper fork mount 834. Protruding from the housing 842 of the steering servo 840 is an output shaft 844 which is shaped to key into a similarly configured opening in the bottom of driving sector gear 832. The cover 836 is mounted on fork mount mounting pins. As can be seen in FIG. 15 the rear (right) pin can move up and down in a slot in cover 836 providing some up/down pivotal movement of the steering mount assembly with respect to the chassis or body it is fixed with and some protection to the mechanism from front end collisions.

Figure 16:
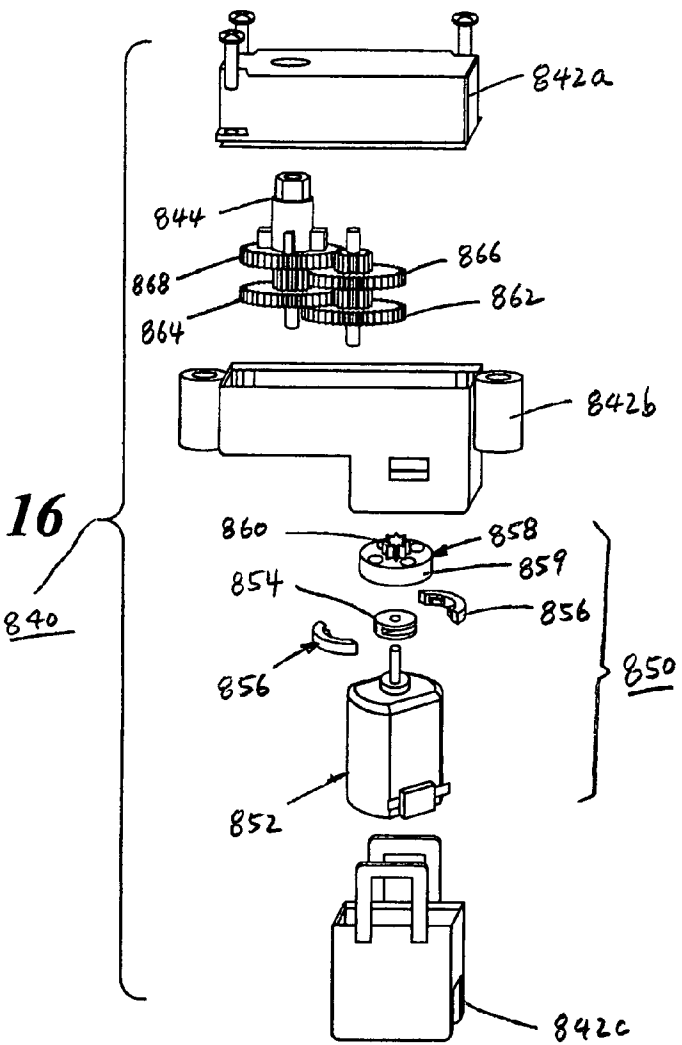
FIG. 16 is an exploded view of a steering motor and gearbox assembly of the steering assembly of FIG. 15.

FIG. 16 is an exploded view of a preferred steering servo 840. Housing 842 includes upper and lower transmission covers 842*a*, 842*b* and a combined motor cover/mount 842*c*. A reversible servo indicated generally at 850 is preferably provided by an actuator in the form of a reversible electric motor 852, and a slip clutch preferably provided by a clutch plate 854, a pair of movable shoes 856, keyed with opposite diametric sides of the clutch plate 854 for axial movement with respect to that plate within a hollow cylindrical housing portion 859 of a combined gear/clutch member 858, thereby forming a slip clutch between the actuator 852 and a pinion 860 on the member 858. Pinion 860 drives a reduction gear train formed by three combined gears 862, 864 and 866 and a final gear 868 fixedly supporting output shaft 844. Clutch members 854, 856, 859 permit the servo actuator/motor 852 to be run continuously in either direction and the fork assembly 810 and front wheel assembly 824 to be turned against the servo actuator/motor 852 without damage to the servo 840.

Finally, related U.S. Provisional Patent Application No. 60/543,760, filed Feb. 11, 2004, and U.S. Provisional Patent Application No. 60/576,273, filed Jun. 2, 2004, each of which is entitled "Remote-Control Toy Vehicle with Dual-Mode Drive Mechanism", is incorporated by reference herein in its entirety.

It will be appreciated by those skilled in the art that changes could be made to the embodiment described above without departing from the broad inventive concept thereof. For example, although the two speed propulsion drive is described with respect to a two-wheeled vehicle, it can be as easily used to drive a pair of wheels in a vehicle having three or more wheels. Furthermore, while this mechanism is described for rotating a road wheel to propel a toy remote-controlled vehicle, it could be used in many other toys where a simple, yet high speed, two-speed transmission is required or desired. Furthermore, while the steering mechanism is described as steering a single castered wheel, it could also be used to pivot a pair of wheels by pivoting a rigid support such as an axle coaxially mounting two wheels, or by moving side-to-side a tie rod or equivalent element coupled with each wheel to pivot each wheel side-to-side in a conventional manner to steer the vehicle. While it may not be easy or possible because of bulk, the steering and propulsion mechanisms described above could be combined so as to propel and steer the same wheel or pair of wheels, for example, to provide front wheel steering and drive in a remote-controlled vehicle. It is understood, therefore, that this invention is not limited to the particular embodiment disclosed, but it is intended to cover modifications within the spirit and scope of the present invention.

I/we claim:

1. A remote-controlled toy vehicle having a first end and a second end, the toy vehicle comprising:

a plurality of road wheels supporting the toy vehicle for movement across a support surface;

a driving motor selectively reversible between first and second directions of rotation; and a drive mechanism drivingly connecting the driving motor to at least one of the plurality of road wheels, such that operation of the driving motor in either of the first and second directions of rotation causes rotation of the at least one road wheel to propel the toy vehicle in only a forward vehicle direction, the drive mechanism including a driving train and a drive output, the driving train being reversible in direction of rotation with reversal of the driving motor, the drive output coupling the driving train with the at least one road wheel and rotating in only one direction regardless of the direction of rotation of the driving motor and the driving train, the drive mechanism further including first and second one-way clutches installed such that, when the driving motor rotates in the first direction of rotation, the first clutch provides driving engagement between the driving motor and the at least one road wheel and the second clutch slips between the driving motor and the at least one road wheel, and, when the driving motor rotates in the second direction of rotation, the second clutch provides driving engagement between the driving motor and the at least one road wheel and the first clutch slips between the driving motor and the at least one road wheel.

2. The remote-controlled toy vehicle of claim 1, wherein the drive mechanism is configured to operate in at least a first mode wherein the at least one road wheel rotates in the forward vehicle direction at a first speed with the driving motor operated at a first motor rotational speed in the first direction of rotation, and a second mode wherein the at least one road wheel rotates in the forward vehicle direction at a second speed different from the first speed with the driving motor operated at the first motor rotational speed in the second direction.

3. The remote-controlled toy vehicle of claim 1, wherein the drive mechanism has a first drive ratio between the driving motor and the at least one road wheel when the driving motor is driven in the first direction of rotation and a second drive ratio between the driving motor and the at least one road wheel and different from the first drive ratio when the driving motor is driven in the second direction of rotation, to drive at least one road wheel in the forward vehicle driving direction at different maximum speeds.

4. The remote-controlled toy vehicle of claim 1, wherein the first and second clutches are driven by the driving motor in opposite rotational directions from one another on the same axis, such that one of the first and second clutches is driven in an engaging direction while the other of the first and second clutches is driving in a slipping direction, thereby enabling only one of the first and second clutches to drivingly engage the drive output at a time.

5. The remote-controlled toy vehicle of claim 1 further comprising: a combined gear operatively engaged with the drive mechanism; and a braking motor operably coupled to the combined gear and selectively powered so as to rotate in a direction opposite to a direction of rotation of the combined gear to apply a resistive load to the combined gear for slowing of the drive mechanism and the toy vehicle.

6. The remote-controlled toy vehicle of claim 5 further comprising a braking train coupling the braking motor with the braking gear, the braking train being driven by a drive output.

7. The remote controlled toy vehicle of claim 5, wherein the combined gear engages a double clutched braking gear, the double clutched breaking gear being part of the drive output and being alternately engageable with first and second clutched members.

8. The remote-controlled toy vehicle of claim 1 further comprising, a steering mechanism pivotably mounted to the toy vehicle proximate the first end, a first road wheel of the plurality being rotatably supported from the toy vehicle on the steering mechanism;

an actuator operably coupled with the steering mechanism so as to pivot the steering mechanism and first road wheel and turn the toy vehicle; and a slip clutch disposed between the actuator and the steering mechanism to permit disengagement of the actuator from the steering mechanism.

9. The remote-controlled toy vehicle of claim 1 further comprising an on-board control unit operably coupled with at least the driving motor and configured to receive and process control signals transmitted from a remote source spaced from the toy vehicle to remotely control movement of the toy vehicle.

10. A remote-controlled toy vehicle having a first end and a second end, the toy vehicle comprising:

a plurality of road wheels supporting the toy vehicle for movement across a support surface;

a driving motor selectively reversible between first and second directions of rotation;

a drive mechanism drivingly connecting the driving motor to at least one of the plurality of road wheels, such that operation of the driving motor in either of the first and second directions of rotation causes rotation of the at least one road wheel to propel the toy vehicle in only a forward vehicle direction;

a combined gear operatively engaged with the drive mechanism; and a braking motor operably coupled to the combined gear and selectively powered so as to rotate in a direction opposite to a direction of rotation of the combined gear to apply a resistive load to the combined gear for slowing of the drive mechanism and the toy vehicle.

11. The remote-controlled toy vehicle of claim 10 further comprising a braking train coupling the braking motor with the braking gear, the braking train being driven by a drive output.

12. The remote-controlled toy vehicle of claim 10, wherein the combined gear engages a double clutched braking gear, the double clutched breaking gear being part of the drive output and being alternately engageable with first and second clutched members.

13. The remote-controlled toy vehicle of claim 10, wherein the drive mechanism is configured to operate in at least a first mode wherein the at least one road wheel rotates in the forward vehicle direction at a first speed with the driving motor operated at a first motor rotational speed in the first direction of rotation, and a second mode wherein the at least one road wheel rotates in the forward vehicle direction at a second speed different from the first speed with the driving motor operated at the first motor rotational speed in the second direction.

14. The remote-controlled toy vehicle of claim 10, wherein the drive mechanism has a first drive ratio between the driving motor and the at least one road wheel when the driving motor is driven in the first direction of rotation and a second drive ratio between the driving motor and the at least one road wheel and different from the first drive ratio when the driving motor is driven in the second direction of rotation, to drive at least one road wheel in the forward vehicle driving direction at different maximum speeds.

15. The remote-controlled toy vehicle of claim 10, wherein the drive mechanism includes a driving train and a drive output, the driving train being reversible in direction of rotation with reversal of the driving motor, the drive output coupling the driving train with the at least one road wheel and rotating in only one direction regardless of the direction of rotation of the driving motor and the driving train.

16. The remote-controlled toy vehicle of claim 15, wherein the drive mechanism further includes first and second one-way clutches installed such that, when the driving motor rotates in the first direction of rotation, the first clutch provides driving engagement between the driving motor and the at least one road wheel and the second clutch slips between the driving motor and the at least one road wheel, and, when the driving motor rotates in the second direction of rotation, the second clutch provides driving engagement between the driving motor and the at least one road wheel and the first clutch slips between the driving motor and the at least one road wheel; and the first and second clutches being driven by the driving motor in opposite rotational directions from one another on the same axis, such that one of the first and second clutches is driven in an engaging direction while the other of the first and second clutches is driving in a slipping direction, thereby enabling only one of the first and second clutches to drivingly engage the drive output at a time.

17. The remote-controlled toy vehicle of claim 10 further comprising, a steering mechanism pivotably mounted to the toy vehicle proximate the first end, a first road wheel of the plurality being rotatably supported from the toy vehicle on the steering mechanism;

an actuator operably coupled with the steering mechanism so as to pivot the steering mechanism and first road wheel and turn the toy vehicle; and a slip clutch disposed between the actuator and the steering mechanism to permit disengagement of the actuator from the steering mechanism.

18. The remote-controlled toy vehicle of claim 10 further comprising an on-board control unit operably coupled with at least the driving motor and configured to receive and process control signals transmitted from a remote source spaced from the toy vehicle to remotely control movement of the toy vehicle.

19. A remote-controlled toy vehicle having a first end and a second end, the toy vehicle comprising:

a plurality of road wheels supporting the toy vehicle for movement across a support surface;

a driving motor selectively reversible between first and second directions of rotation; and a drive mechanism drivingly connecting the driving motor to at least one of the plurality of road wheels, such that operation of the driving motor in either of the first and second directions of rotation causes rotation of the at least one road wheel to propel the toy vehicle in only a forward vehicle direction:

a steering mechanism pivotably mounted to the toy vehicle proximate the first end, a first road wheel of the plurality being rotatably supported from the toy vehicle on the steering mechanism;

an actuator operably coupled with the steering mechanism so as to pivot the steering mechanism and first road wheel and turn the toy vehicle; and a slip clutch disposed between the actuator and the steering mechanism to permit disengagement of the actuator from the steering mechanism.

20. The remote-controlled toy vehicle of claim 19 further comprising an on-board control unit operably coupled with at least the driving motor and configured to receive and process control signals transmitted from a remote source spaced from the toy vehicle to remotely control movement of the toy vehicle.

21. The remote-controlled toy vehicle of claim 19, wherein the drive mechanism is configured to operate in at least a first mode wherein the at least one road wheel rotates in the forward vehicle direction at a first speed with the driving motor operated at a first motor rotational speed in the first direction of rotation, and a second mode wherein the at least one road wheel rotates in the forward vehicle direction at a second speed different from the first speed with the driving motor operated at the first motor rotational speed in the second direction.

22. The remote-controlled toy vehicle of claim 19, wherein the drive mechanism has a first drive ratio between the driving motor and the at least one road wheel when the driving motor is driven in the first direction of rotation and a second drive ratio between the driving motor and the at least one road wheel and different from the first drive ratio when the driving motor is driven in the second direction of rotation, to drive at least one road wheel in the forward vehicle driving direction at different maximum speeds.

23. The remote-controlled toy vehicle of claim 19, wherein the drive mechanism includes a driving train and a drive output, the driving train being reversible in direction of rotation with reversal of the driving motor, the drive output coupling the driving train with the at least one road wheel and rotating in only one direction regardless of the direction of rotation of the driving motor and the driving train.

24. The remote-controlled toy vehicle of claim 23, the drive mechanism further including first and second one-way clutches installed such that, when the driving motor rotates in the first direction of rotation, the first clutch provides driving engagement between the driving motor and the at least one road wheel and the second clutch slips between the driving motor and the at least one road wheel, and, when the driving motor rotates in the second direction of rotation, the second clutch provides driving engagement between the driving motor and the at least one road wheel and the first clutch slips between the driving motor and the at least one road wheel; and the first and second clutches being driven by the driving motor in opposite rotational directions from one another on the same axis, such that one of the first and second clutches is driven in an engaging direction while the other of the first and second clutches is driving in a slipping direction, thereby enabling only one of the first and second clutches to drivingly engage the drive output at a time.

25. The remote-controlled toy vehicle of claim 19 further comprising:

a combined gear operatively engaged with the drive mechanism;

a braking motor operably coupled to the combined gear and selectively powered so as to rotate in a direction opposite to a direction of rotation of the combined gear to apply a resistive load to the combined gear for slowing of the drive mechanism and the toy vehicle; and a braking train coupling the braking motor with the braking gear, the braking train being driven by a drive output.

26. The remote-controlled toy vehicle of claim 19 further comprising:

a combined gear operatively engaged with the drive mechanism; and a braking motor operably coupled to the combined gear and selectively powered so as to rotate in a direction opposite to a direction of rotation of the combined gear to apply a resistive load to the combined gear for slowing of the drive mechanism and the toy vehicle;

wherein the combined gear engages a double clutched braking gear, the double clutched breaking gear being part of the drive output and being alternately engageable with first and second clutched members.

27. A remote-controlled toy vehicle having a first end and a second end, the toy vehicle comprising:

a plurality of road wheels supporting the toy vehicle for movement across a support surface;

a drive output drivingly coupled with at least one road wheel of the plurality of road wheels to rotate the at least one road wheel;

a first motor coupled with the drive output through a first train; and a second motor coupled with the drive output through a second train, each of the first and second motors being selectively reversible between first and second directions of rotation;

wherein selective rotation of one motor of the first and second motors in the first rotational direction while the other motor of the first and second motors is unpowered causes rotation of the at least one road wheel to propel the toy vehicle in a forward vehicle direction and rotation of the other motor in the first rotational direction of the other motor, such that energization of the other motor in the second rotational direction of the other motor while the toy vehicle is traveling in the forward vehicle direction applies a resistive load to the drive output to slow the toy vehicle.

28. The remote-controlled toy vehicle of claim 27, wherein the toy vehicle is configured to operate in at least a first mode in which the at least one wheel rotates in the forward vehicle direction at a first speed with the one motor operated at a first motor rotational speed in the first rotational direction of the one motor, and a second mode wherein the at least one wheel rotates in the forward vehicle direction at a second speed different from the first speed with the other motor operated at the first motor rotational speed in the first rotational direction of the other motor.

29. The remote-controlled toy vehicle of claim 28, wherein at least the first train includes first and second one-way clutches installed such that, when the first motor rotates in the first direction of rotation, the first clutch provides driving engagement between the motor and the at least one road wheel and the second clutch slips between the motor and the at least one road wheel, and, when the first motor rotates in the second direction of rotation, the second clutch provides driving engagement between the first motor and the at least one road wheel and the first clutch slips between the first motor and the at least one road wheel, such that the toy vehicle operates in a third mode in which the at least one wheel rotates in the forward vehicle direction at a third speed different from the first and second speeds with the first motor operated at the first motor rotational speed in the second rotational direction of the first motor.

30. The remote-controlled toy vehicle of claim 29, wherein the toy vehicle has a first drive ratio between the first motor and the at least one road wheel when the first motor is driven in the first direction of rotation, a second drive ratio between the second motor and the at least one road wheel, and a third drive ratio between the first motor and the at least one road wheel when the first motor is driven in the second direction of rotation, the first, second and third ratios being different from one another.

31. The remote-controlled toy vehicle of claim 29, wherein the first and second clutches are driven by the first motor in opposite rotational directions from one another, such that one of the first and second clutches is driven in an engaging direction while the other of the first and second clutches is driving in a slipping direction, thereby enabling only one of the first and second clutches to drivingly engage the drive output at a time.

32. The remote-controlled toy vehicle of claim 27 further comprising an on-board control unit operably coupled with the first and second motors and configured to receive and process control signals transmitted from a remote source spaced from the toy vehicle to remotely control operation of the first and second motors.

33. The remote-controlled toy vehicle of claim 27 further comprising:

a steering mechanism pivotably mounted to the toy vehicle proximate the first end of the vehicle, at least a first road wheel of the plurality being supported from the toy vehicle on the steering mechanism for free rotation;

an actuator operably coupled with the steering mechanism so as to pivot the steering mechanism and first road wheel and turn the toy vehicle; and a slip clutch disposed between the actuator and the steering mechanism to permit disengagement of the actuator from the steering mechanism.

34. A remote-controlled toy vehicle having a first end and a second end, the toy vehicle comprising:

a plurality of road wheels supporting the toy vehicle for movement across a support surface;

a drive output drivingly coupled with at least one road wheel of the plurality of road wheels to rotate the at least one road wheel;

a first motor coupled with the drive output through a first train; and a second motor coupled with the drive output through a second train, each of the first and second motors being selectively reversible between first and second directions of rotation;

wherein selective rotation of either of the first and second motors in the first rotational direction while the other motor of the first and second motors is unpowered causes rotation of the at least one road wheel to propel the toy vehicle in a forward vehicle direction and rotation of the other motor in the first rotational direction of the other motor.

35. The remote-controlled toy vehicle of claim 34, wherein a first drive ratio between the first motor and the at least one road wheel differs from a second drive ratio between the second motor and the at least one road wheel.

36. The remote-controlled toy vehicle of claim 34, wherein the first and second motors are operably coupled together at all times through the drive output such that the first and second motors and the at least one road wheel all rotate together.

37. The remote-controlled toy vehicle of claim 36, wherein the first train includes first and second clutches that are driven by the first motor in opposite rotational directions from one another on the same axis, such that one of the first and second clutches is driven in an engaging direction while the other of the first and second clutches is driven in a slipping direction, thereby enabling only one of the first and second clutches to drivingly engage the drive output at a time, so as to allow the first motor to drive the at least one road wheel in the forward vehicle direction regardless of the direction of rotation of the first motor.

* * * * *